US008588638B2

(12) United States Patent
Iwaya et al.

(10) Patent No.: US 8,588,638 B2
(45) Date of Patent: Nov. 19, 2013

(54) FIXING DEVICE AND IMAGE FORMING APPARATUS INCORPORATING SAME

(75) Inventors: Naoki Iwaya, Tokyo (JP); Masaaki Yoshikawa, Tokyo (JP); Kenji Ishii, Kanagawa (JP); Hiroshi Yoshinaga, Chiba (JP); Tetsuo Tokuda, Kanagawa (JP); Yoshiki Yamaguchi, Kanagawa (JP); Yutaka Ikebuchi, Kanagawa (JP); Ippei Fujimoto, Kanagawa (JP); Takuya Seshita, Kanagawa (JP); Takahiro Imada, Kanagawa (JP); Takamasa Hase, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 351 days.

(21) Appl. No.: 13/041,729

(22) Filed: Mar. 7, 2011

(65) Prior Publication Data

US 2011/0229181 A1 Sep. 22, 2011

(30) Foreign Application Priority Data

Mar. 16, 2010 (JP) ..... 2010-058725

(51) Int. Cl.
*G03G 15/20* (2006.01)

(52) U.S. Cl.
USPC ..... 399/69

(58) Field of Classification Search
USPC ..... 399/69, 122, 329
See application file for complete search history.

(56) References Cited

U.S. PATENT DOCUMENTS

| | | | | |
|---|---|---|---|---|
| 7,235,761 | B1 * | 6/2007 | Maul et al. | 219/216 |
| 7,620,338 | B2 * | 11/2009 | Yamada et al. | 399/70 |
| 8,364,052 | B2 | 1/2013 | Iwaya et al. | |
| 8,385,804 | B2 | 2/2013 | Hasegawa et al. | |
| 8,391,743 | B2 | 3/2013 | Ehara et al. | |
| 8,401,448 | B2 | 3/2013 | Hasegawa et al. | |
| 8,406,647 | B2 | 3/2013 | Shinshi et al. | |
| 8,422,901 | B2 | 4/2013 | Ishii et al. | |

(Continued)

FOREIGN PATENT DOCUMENTS

| | | |
|---|---|---|
| JP | 10-213984 | 8/1998 |
| JP | 4044075 | 2/1999 |

(Continued)

OTHER PUBLICATIONS

Office Action issued in Mar. 6, 2013, in Chinese patent Application No. 201110053524.3.

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A fixing device for fixing a toner image on a recording medium includes a pressing member provided outside a loop formed by a fixing member to press the fixing member against a nip formation member provided inside the loop formed by the fixing member. A heat generator support is provided inside the loop formed by the fixing member to support a heat generator that generates heat to be transmitted to the fixing member. A temperature detector is provided downstream from the heat generator and upstream from the nip formation member in a direction of rotation of the fixing member to detect a temperature of the fixing member. A controller is connected to the temperature detector and the heat generator to control heat generation of the heat generator based on the temperature of the fixing member detected by the temperature detector.

6 Claims, 10 Drawing Sheets

(56) References Cited

U.S. PATENT DOCUMENTS

| | | | | |
|---|---|---|---|---|
| 8,428,502 | B2 | 4/2013 | Tokuda et al. | |
| 2002/0146255 | A1* | 10/2002 | Kishimoto et al. | 399/69 |
| 2004/0052548 | A1* | 3/2004 | Shimizu et al. | 399/122 |
| 2007/0217806 | A1* | 9/2007 | Kurokawa | 399/69 |
| 2008/0175633 | A1* | 7/2008 | Shinshi | 399/329 |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290796 | A1* | 11/2010 | Sato | 399/33 |
| 2010/0290822 | A1 | 11/2010 | Hasegawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058864 | A1 | 3/2011 | Shinshi et al. | |
| 2011/0058866 | A1 | 3/2011 | Ishii et al. | |
| 2011/0064437 | A1 | 3/2011 | Yamashina et al. | |
| 2011/0064490 | A1 | 3/2011 | Imada et al. | |
| 2011/0064502 | A1 | 3/2011 | Ehara et al. | |
| 2011/0085832 | A1 | 4/2011 | Hasegawa et al. | |
| 2011/0116848 | A1 | 5/2011 | Yoshikawa et al. | |
| 2011/0129268 | A1 | 6/2011 | Ishii et al. | |
| 2011/0222929 | A1* | 9/2011 | Fujimoto et al. | 399/329 |

FOREIGN PATENT DOCUMENTS

| | | |
|---|---|---|
| JP | 8262903 | 4/2002 |
| JP | 11002982 | 9/2004 |
| JP | 2007-334205 | 12/2007 |
| JP | 2010-20244 A | 1/2010 |

* cited by examiner

FIG. 15A
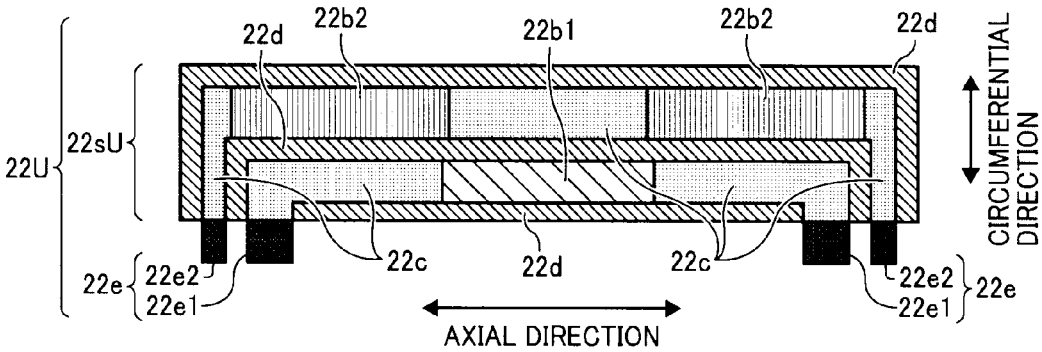
FIG. 15B
ELEMENTS OF DIVIDED REGIONS
| | | |
|---|---|---|
| (2, 1) | (2, 2) | (2, 3) |
| (1, 1) | (1, 2) | (1, 3) |
FIG. 16
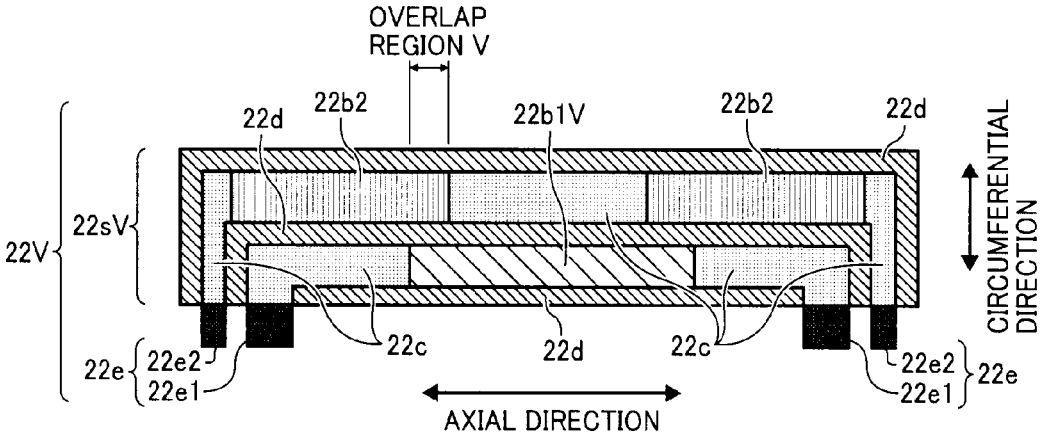

FIXING DEVICE AND IMAGE FORMING APPARATUS INCORPORATING SAME

CROSS-REFERENCE TO RELATED APPLICATIONS

The present application is based on and claims priority to Japanese Patent Application No. 2010-058725, filed on Mar. 16, 2010, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus foaming the image on the recording medium.

The fixing device used in such image forming apparatuses may include a fixing belt or a fixing film to apply heat to the recording medium bearing the toner image. FIG. 1 is a vertical sectional view of a fixing device 20R1 including such a fixing belt 204. The fixing belt 204 is looped around a heating roller 202 and a fixing roller 203, in a state in which a tension roller 206 biases the fixing belt 204. A pressing roller 205 presses against the fixing roller 203 via the fixing belt 204 to form a nip N between the pressing roller 205 and the fixing belt 204. The fixing belt 204 is heated by a heater 201 provided inside the heating roller 202. As a recording medium P bearing a toner image passes between the fixing roller 203 and the pressing roller 205 on the fixing belt 204, the fixing belt 204 and the pressing roller 205 together apply heat and pressure to the recording medium P bearing the toner image to fix the toner image on the recording medium P.

One problem with such an arrangement, however, is that the heating roller 202 has a relatively large heat capacity, resulting in a longer warm-up time for the fixing device 20R1. To address this problem, instead of the fixing belt 204 the fixing device may include a fixing film having a relatively small heat capacity. FIG. 2 is a vertical sectional view of such a fixing device 20R2 including a fixing film 213. A ceramic heater 211 is provided inside a loop formed by the fixing film 213. A pressing roller 212 presses against the ceramic heater 211 via the fixing film 213 to form a nip N between the pressing roller 212 and the fixing film 213. As a recording medium bearing a toner image passes between the pressing roller 212 and the fixing film 213, the fixing film 213 heated by the ceramic heater 211 and the pressing roller 212 together apply heat and pressure to the recording medium bearing the toner image to fix the toner image on the recording medium.

However, the fixing film 213 also has a drawback in that, over time, friction between the ceramic heater 211 and the fixing film 213 sliding over the ceramic heater 211 increases, resulting eventually in unstable movement of the fixing film 213 and increasing the required driving torque of the fixing device 20R2.

Moreover, the temperature of the fixing device as the recording medium bearing the toner image enters the fixing device is critical to imaging outcome. In this respect, the fixing film 213 has another drawback in that the ceramic heater 211 heats the fixing film 213 at the nip N only, and therefore the rotating fixing film 213 is coolest when it reenters the nip N, resulting in formation of a faulty toner image on the recording medium due to the lower temperature of the fixing film 213 at that location.

To overcome these drawbacks, instead of the ceramic heater 211 the fixing device may include a heat generator provided inside the loop formed by the fixing film to heat the fixing film locally, and the temperature of the fixing film is detected by a temperature detector. However, there is a certain distance or a gap between the heat generator and the nip N in the direction of rotation of the fixing film, and the temperature detector is typically disposed in proximity to the heat generator. Accordingly, even if the temperature of the fixing film is controlled based on the temperature of the fixing film detected by the temperature detector disposed near the heat generator, the fixing film is still cooled when it enters the nip N. In other words, the temperature of the fixing film at the position where the heat generator faces and heats the fixing film directly may be different from the temperature of the fixing film at the nip N. As a result, a faulty toner image is formed on the recording medium due to the unstable fixing temperature of the fixing film at the nip N.

BRIEF SUMMARY OF THE INVENTION

This specification describes below an improved fixing device. In one exemplary embodiment of the present invention, the fixing device fixes a toner image on a recording medium and includes an endless belt-shaped fixing member, a nip formation member, a pressing member, a heat generator, a heat generator support, a temperature detector, and a controller. The fixing member is formed into a loop and rotates in a predetermined direction of rotation. The nip formation member is provided inside the loop formed by the fixing member. The pressing member is provided outside the loop formed by the fixing member and opposite the nip formation member to press the fixing member against the nip formation member to form a nip between the pressing member and the fixing member through which the recording medium bearing the toner image passes. The heat generator faces an inner circumferential surface of the fixing member to heat the fixing member. The heat generator support is provided inside the loop formed by the fixing member to support the heat generator at a predetermined position between the fixing member and the heat generator support. The temperature detector is provided downstream from the heat generator and upstream from the nip formation member in the direction of rotation of the fixing member to detect a temperature of the fixing member. The controller is connected to the temperature detector and the heat generator to control heat generation of the heat generator based on the temperature of the fixing member detected by the temperature detector.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein:

FIG. 15A is a plan view of a laminated heater as a first variation of the laminated heater shown in FIG. 6;

FIG. 15B is a lookup table matrix showing regions on the laminated heater shown in FIG. 15A;

FIG. 16 is a plan view of a laminated heater as a second variation of the laminated heater shown in FIG. 6;

DETAILED DESCRIPTION OF THE INVENTION

Figure 1:
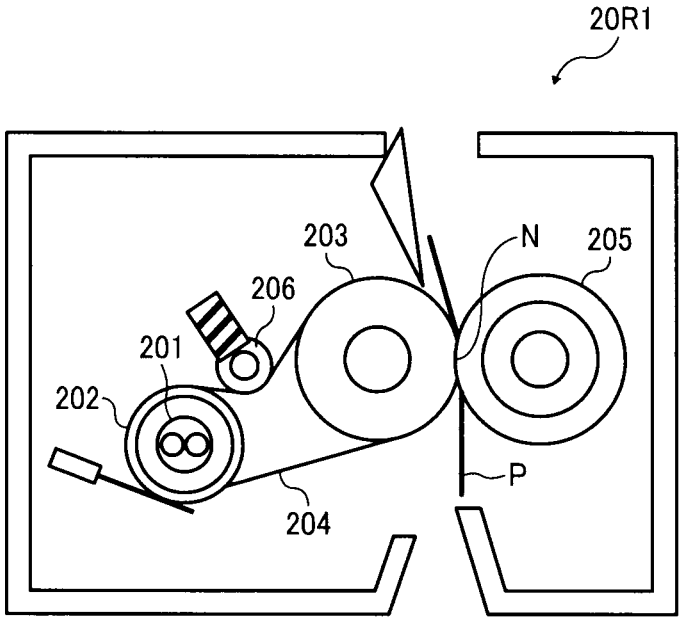
FIG. 1 RELATED ART
FIG. 1 is a schematic view of a related-art fixing device.
Figure 2:
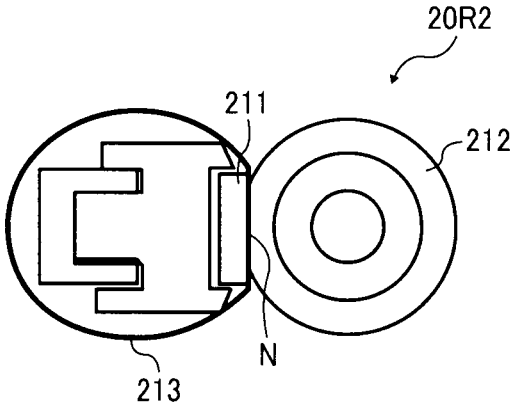
FIG. 2 RELATED ART
FIG. 2 is a schematic view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 3:
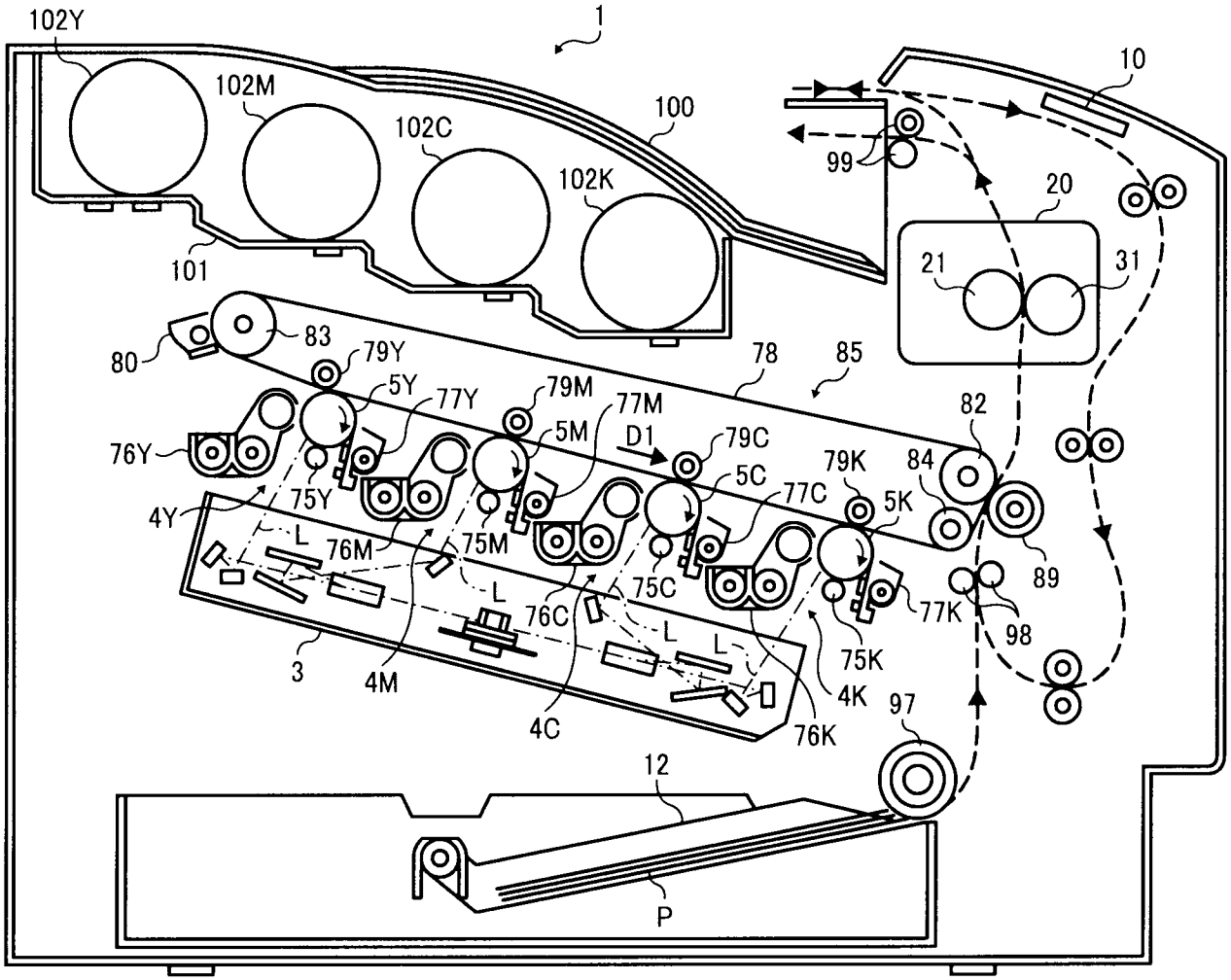
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus 1 according to an exemplary embodiment of the present invention is explained.

FIG. 3 is a schematic view of the image forming apparatus 1. As illustrated in FIG. 3, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 3, the image forming apparatus 1 includes image forming devices 4Y, 4M, 4C, and 4K disposed in a center portion of the image forming apparatus 1, a toner bottle holder 101 disposed above the image forming devices 4Y, 4M, 4C, and 4K in an upper portion of the image forming apparatus 1, an exposure device 3 disposed below the image forming devices 4Y, 4M, 4C, and 4K, a paper tray 12 disposed below the exposure device 3 in a lower portion of the image forming apparatus 1, an intermediate transfer unit 85 disposed above the image forming devices 4Y, 4M, 4C, and 4K, a second transfer roller 89 disposed opposite the intermediate transfer unit 85, a feed roller 97 and a registration roller pair 98 disposed between the paper tray 12 and the second transfer roller 89 in a recording medium conveyance direction, a fixing device 20 disposed above the second transfer roller 89, an output roller pair 99 disposed above the fixing device 20, a stack portion 100 disposed downstream from the output roller pair 99 in the recording medium conveyance direction on top of the image forming apparatus 1, and a controller 10 disposed in the upper portion of the image forming apparatus 1.

The toner bottle holder 101 includes toner bottles 102Y, 102M, 102C, and 102K. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is disposed below the toner bottle holder 101, and includes an intermediate transfer belt 78 formed into a loop, four first transfer bias rollers 79Y, 79M, 79C, and 79K, a second transfer backup roller 82, a cleaning backup roller 83, and a tension roller 84 disposed inside the loop formed by the intermediate transfer belt 78, and an intermediate transfer cleaner 80 disposed outside the loop formed by the intermediate transfer belt 78. Specifically, the intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction D1.

The image forming devices 4Y, 4M, 4C, and 4K are arranged opposite the intermediate transfer belt 78, and form yellow, magenta, cyan, and black toner images, respectively. The image forming devices 4Y, 4M, 4C, and 4K include photoconductive drums 5Y, 5M, 5C, and 5K which are surrounded by chargers 75Y, 75M, 75C, and 75K, development devices 76Y, 76M, 76C, and 76K, cleaners 77Y, 77M, 77C, and 77K, and dischargers, respectively. Image forming processes including a charging process, an exposure process, a development process, a primary transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively, as a driving motor drives and rotates the photoconductive drums 5Y, 5M, 5C, and 5K clockwise in FIG. 3.

Specifically, in the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the respective photoconductive drums 5Y, 5M, 5C, and 5K according to image data sent from a client computer, for example. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the primary transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The following describes the transfer processes, that is, the primary transfer process described above and a secondary transfer process, performed on the intermediate transfer belt 78. The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, in the primary transfer process, the yellow, magenta, cyan, and black toner images formed on the photoconductive drums 5Y, 5M, 5C, and 5K, respectively, are primarily transferred and superimposed onto the intermediate transfer belt 78 rotating in the direction D1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The second transfer roller 89 is pressed against the second transfer backup roller 82 via the intermediate transfer belt 78 in such a manner that the second transfer roller 89 and the second transfer backup roller 82 sandwich the intermediate transfer belt 78 to form a second transfer nip between the second transfer roller 89 and the intermediate transfer belt 78. At the second transfer nip, the second transfer roller 89 secondarily transfers the color toner image formed on the intermediate transfer belt 78 onto a recording medium P sent from the paper tray 12 through the feed roller 97 and the registration roller pair 98 in the secondary transfer process. Thus, the desired color toner image is formed on the recording medium P. After the transfer of the color toner image, residual toner, which has not been transferred onto the recording medium P, remains on the intermediate transfer belt 78.

Thereafter, the intermediate transfer cleaner 80 collects the residual toner from the intermediate transfer belt 78 at a cleaning position at which the intermediate transfer cleaner 80 is disposed opposite the cleaning backup roller 83 via the intermediate transfer belt 78, thus completing a single sequence of transfer processes performed on the intermediate transfer belt 78.

The recording medium P is supplied to the second transfer nip from the paper tray 12 which loads a plurality of recording media P (e.g., transfer sheets). Specifically, the feed roller 97 rotates counterclockwise in FIG. 3 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip.

After the secondary transfer process described above, the recording medium P bearing the color toner image is sent to the fixing device 20 that includes a fixing sleeve 21 and a pressing roller 31. The fixing sleeve 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image foaming apparatus 1, that is, the stack portion 100. Thus, the recording media P discharged by the output roller pair 99 are stacked on the stack portion 100 successively to complete a single sequence of image forming processes performed by the image forming apparatus 1.

Figure 4:
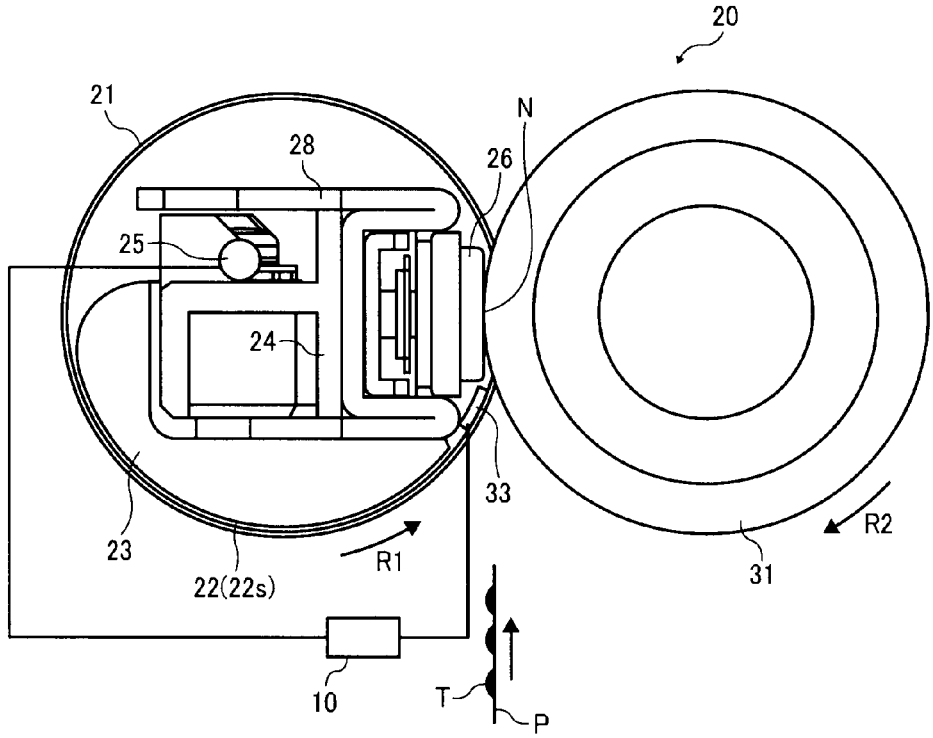
FIG. 4 is a vertical sectional view of a fixing device included in the image foaming apparatus shown in FIG. 3.

Referring to FIG. 4, the following describes the structure of the fixing device 20. FIG. 4 is a vertical sectional view of the fixing device 20. As illustrated in FIG. 4, the fixing device 20 includes the fixing sleeve 21 formed into a loop, a laminated heater 22, a heater support 23, a terminal stay 24, power supply wiring 25, a nip formation member 26, a core holder 28, and a thermistor 33, which are disposed inside the loop formed by the fixing sleeve 21, and the pressing roller 31 disposed outside the loop formed by the fixing sleeve 21.

As illustrated in FIG. 4, the fixing sleeve 21 is a rotatable endless belt serving as a fixing member or a rotary fixing member that rotates in a rotation direction R1. The pressing roller 31 serves as a pressing member or a rotary pressing member that rotates in a rotation direction R2 counter to the rotation direction R1, and contacts an outer circumferential surface of the fixing sleeve 21 to press the fixing sleeve 21 against the nip formation member 26. The nip formation member 26 faces an inner circumferential surface of the fixing sleeve 21, and is pressed against the pressing roller 31 via the fixing sleeve 21 to form a nip N between the pressing roller 31 and the fixing sleeve 21 through which the recording medium P bearing a toner image T passes. The laminated heater 22 also faces the inner circumferential surface of the fixing sleeve 21 in such a manner that the laminated heater 22 is capable of contacting or being disposed in close proximity to the inner circumferential surface of the fixing sleeve 21, and serves as a heat generator that generates heat to be transmitted to the fixing sleeve 21. The heater support 23 faces the inner circumferential surface of the fixing sleeve 21 and serves as a heat generator support that supports the laminated heater 22 serving as a heat generator at a predetermined position, in such a manner that the laminated heater 22 is provided between the heater support 23 and the fixing sleeve 21. The thermistor 33 is provided downstream from the heater support 23 and upstream from the nip formation member 26 in the rotation direction R1 of the fixing sleeve 21, and serves as a temperature detector that detects a temperature of the fixing sleeve 21 so that the temperature of the fixing sleeve 21 is controlled based on a detection result of the thermistor 33.

As noted above, FIG. 4 illustrates a case in which the laminated heater 22 directly contacts the inner circumferential surface of the fixing sleeve 21 to heat the fixing sleeve 21 directly. Alternatively, the fixing device 20 may further include a fixing sleeve support (e.g., a pipe-shaped metal heat conductor) that supports and guides the fixing sleeve 21 rotating in the rotation direction R1.

Figure 5A:
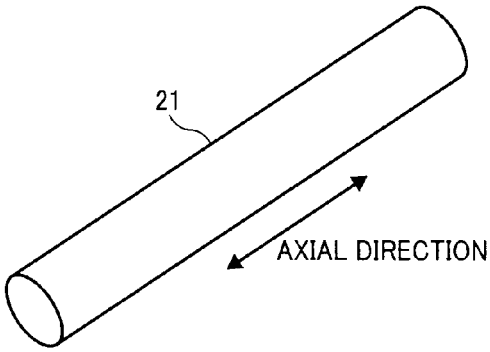
FIG. 5A is a perspective view of a fixing sleeve included in the fixing device shown in FIG. 4.
Figure 5B:
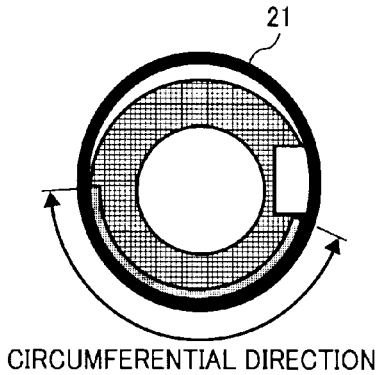
FIG. 5B is a vertical sectional view of the fixing sleeve shown in FIG. 5A.

Referring to FIGS. 5A and 5B, the following describes the fixing sleeve 21. FIG. 5A is a perspective view of the fixing sleeve 21. FIG. 5B is a vertical sectional view of the fixing sleeve 21. As illustrated in FIG. 5A, the fixing sleeve 21 is a flexible, pipe-shaped or cylindrical endless belt having a predetermined width in an axial direction of the fixing sleeve 21, which corresponds to a width of a recording medium P passing through the nip N formed between the fixing sleeve 21 and the pressing roller 31 depicted in FIG. 4. As illustrated in FIG. 5A, the axial direction of the pipe-shaped fixing sleeve 21 corresponds to a long axis, that is, a longitudinal direction, of the fixing sleeve 21. By contrast, as illustrated in FIG. 5B, a circumferential direction of the pipe-shaped fixing sleeve 21 extends along a circumference of the fixing sleeve 21 or in the rotation direction R1 of the fixing sleeve 21, orthogonal to the long axis of the fixing sleeve 21.

For example, the fixing sleeve 21 has an outer diameter of about 30 mm, and is constructed of a base layer made of a metal material and having a thickness in a range of from about 30 μm to about 50 μm, and at least a release layer provided on the base layer. The base layer of the fixing sleeve 21 is made of a conductive metal material such as iron, cobalt, nickel, an alloy of those, or the like. The release layer of the fixing sleeve 21 is a tube that covers the base layer. The release layer has a thickness of about 50 μm and is made of fluorine compound such as tetrafluoroethylene-perfluoroalkylvinylether copolymer (PFA). The release layer facilitates separation of toner of the toner image T on the recording medium P, which contacts the outer circumferential surface of the fixing sleeve 21 directly, from the fixing sleeve 21.

On the other hand, the pressing roller 31 depicted in FIG. 4 has an outer diameter of about 30 mm, and is constructed of a metal core made of a metal material such as aluminum or copper; a heat-resistant elastic layer provided on the metal core and made of silicon rubber (e.g., solid rubber); and a release layer provided on the elastic layer. The elastic layer has a thickness of about 2 mm. The release layer is a PFA tube covering the elastic layer and has a thickness of about 50 μm. Optionally, a heat generator, such as a halogen heater, may be provided inside the metal core as needed.

The pressing roller 31 is connected to a pressure apply-release mechanism that applies pressure to the pressing roller 31 to cause the pressing roller 31 to contact the outer circumferential surface of the fixing sleeve 21 and releases the pressure to separate the pressing roller 31 from the fixing sleeve 21. Specifically, the pressure apply-release mechanism applies pressure to the pressing roller 31 to press the pressing roller 31 against the nip formation member 26 via the fixing sleeve 21 to form the nip N between the pressing roller 31 and the fixing sleeve 21. For example, a portion of the pressing roller 31 contacting the fixing sleeve 21 causes a concave portion of the fixing sleeve 21 at the nip N. Thus, the recording medium P passing through the nip N moves along the concave portion of the fixing sleeve 21.

A driving mechanism drives and rotates the pressing roller 31, which presses the fixing sleeve 21 against the nip formation member 26, clockwise in FIG. 4 in the rotation direction R2. Accordingly, the fixing sleeve 21 rotates in accordance with rotation of the pressing roller 31 counterclockwise in FIG. 4 in the rotation direction R1.

A longitudinal direction of the nip formation member 26 is parallel to the axial direction of the fixing sleeve 21. At least a portion of the nip formation member 26 which is pressed against the pressing roller 31 via the fixing sleeve 21 is made of a heat-resistant elastic material such as fluorocarbon rubber. The core holder 28 supports and holds the nip formation member 26 at a predetermined position inside the loop formed by the fixing sleeve 21. Preferably, a portion of the nip formation member 26 which contacts the inner circumferential surface of the fixing sleeve 21 may be made of a slidable and durable material such as Teflon® sheet. Alternatively, a lubricant (e.g., grease) may be applied to the inner circumferential surface of the fixing sleeve 21 to facilitate sliding of the fixing sleeve 21 over the nip formation member 26.

The core holder 28 is made of sheet metal, and has a predetermined width in a longitudinal direction thereof, corresponding to a width of the fixing sleeve 21 in the axial direction of the fixing sleeve 21. The core holder 28 is an H-shaped rigid member in cross-section, and is disposed at substantially a center position inside the loop formed by the fixing sleeve 21.

The core holder 28 holds the respective components disposed inside the loop formed by the fixing sleeve 21 at predetermined positions. For example, the H-shaped core holder 28 includes a first concave portion facing the pressing roller 31, which houses and holds the nip formation member 26. In other words, the core holder 28 is disposed opposite the pressing roller 31 via the nip formation member 26 to support the nip formation member 26 at a back face of the nip formation member 26 disposed back-to-back to a front face of the nip formation member 26 facing the nip N. Accordingly, even when the pressing roller 31 presses the fixing sleeve 21 against the nip formation member 26, the core holder 28 prevents substantial deformation of the nip formation member 26. In addition, the nip formation member 26 held by the core holder 28 protrudes from the core holder 28 slightly toward the pressing roller 31 to isolate the core holder 28 from the fixing sleeve 21 without contacting the fixing sleeve 21 at the nip N.

The H-shaped core holder 28 further includes a second concave portion disposed back-to-back to the first concave portion, which houses and holds the terminal stay 24 and the power supply wiring 25. The terminal stay 24 has a predetermined width in a longitudinal direction thereof, corresponding to the width of the fixing sleeve 21 in the axial direction of the fixing sleeve 21, and is T-shaped in cross-section. The power supply wiring 25 extends on the terminal stay 24, and transmits power supplied from an outside of the fixing device 20. A part of an outer circumferential surface of the core holder 28 holds the heater support 23 that supports the laminated heater 22. In FIG. 4, the core holder 28 holds the heater support 23 in a lower half region inside the loop formed by the fixing sleeve 21, that is, in a semicircular region provided upstream from the nip N in the rotation direction R1 of the fixing sleeve 21. The heater support 23 can be adhered to the core holder 28 to facilitate assembly. Alternatively, the heater support 23 may not be adhered to the core holder 28 to suppress heat transmission from the heater support 23 to the core holder 28.

The heater support 23 supports the laminated heater 22 in such a manner that the laminated heater 22 contacts the inner circumferential surface of the fixing sleeve 21 or the laminated heater 22 is disposed in close proximity to the inner circumferential surface of the fixing sleeve 21 across a predetermined gap therebetween. Accordingly, the heater support 23 includes an arc-shaped outer circumferential surface portion having a predetermined circumferential length and disposed along the inner circumferential surface of the circular fixing sleeve 21 in cross-section.

Preferably, the heater support 23 has a heat resistance that resists heat generated by the laminated heater 22, a strength sufficient to support the laminated heater 22 without being deformed by the fixing sleeve 21 even when the rotating fixing sleeve 21 contacts the laminated heater 22, and sufficient heat insulation so that heat generated by the laminated heater 22 is not transmitted to the core holder 28 but is transmitted to the fixing sleeve 21. For example, the heater support 23 is molded foam made of polyimide resin. Specifically, when the laminated heater 22 is configured to contact the inner circumferential surface of the fixing sleeve 21, the rotating fixing sleeve 21 applies tension to the laminated heater 22, which pulls and stretches the laminated heater 22 toward the nip N. To resist this tension, the heater support 23 is required to have a strength sufficient to support the laminated heater 22 without being deformed. To address this requirement, the heater support 23 is molded foam made of polyimide resin. Alternatively, a supplemental solid resin member may be provided inside the molded foam made of polyimide resin to improve rigidity.

Figure 6:
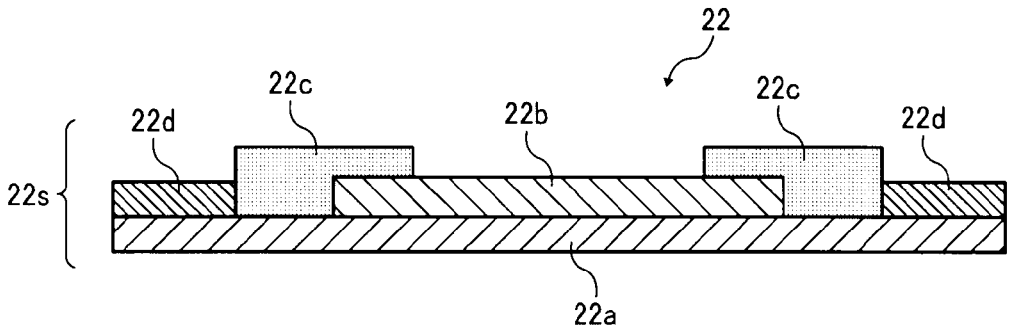
FIG. 6 is a horizontal sectional view of a laminated heater included in the fixing device shown in FIG. 4.

Referring to FIG. 6, the following describes the laminated heater 22. FIG. 6 is a horizontal sectional view of the laminated heater 22. As illustrated in FIG. 6, the laminated heater 22 includes a heat generation sheet 22*s* constructed of a base layer 22*a* having insulation; a resistant heat generation layer 22*b* provided on the base layer 22*a* and including conductive particles dispersed in a heat-resistant resin; an electrode layer 22*c* provided on the base layer 22*a* to supply power to the resistant heat generation layer 22*b*; and an insulation layer 22*d* provided on the base layer 22*a*. The heat generation sheet 22*s* is flexible, and has a predetermined width in the axial direction of the fixing sleeve 21 depicted in FIG. 5A and a predetermined length in the circumferential direction of the fixing sleeve 21 depicted in FIG. 5B. The insulation layer 22*d* insulates one resistant heat generation layer 22*b* from the adjacent electrode layer 22*c* of a different power supply system, and insulates an edge of the heat generation sheet 22*s* from an outside of the heat generation sheet 22*s*.

The heat generation sheet 22*s* has a thickness in a range of from about 0.1 mm to about 1.0 mm, and has a flexibility sufficient to wrap around the heater support 23 depicted in FIG. 4 at least along an outer circumferential surface of the heater support 23.

The base layer 22*a* is a thin, elastic film made of a resin having a certain level of heat resistance, such as polyethylene terephthalate (PET) or polyimide resin. For example, the base layer 22*a* may be a film made of polyimide resin to provide heat resistance, insulation, and a certain level of flexibility.

The resistant heat generation layer 22*b* is a thin, conductive film in which conductive particles, such as carbon particles and metal particles, are uniformly dispersed in a heat-resistant resin such as polyimide resin. When power is supplied to the resistant heat generation layer 22*b*, internal resistance of the resistant heat generation layer 22*b* generates Joule heat. The resistant heat generation layer 22*b* is manufactured by coating the base layer 22*a* with a coating compound in which conductive particles, such as carbon particles and metal particles, are dispersed in a precursor made of a heat-resistant resin such as polyimide resin.

Alternatively, the resistant heat generation layer 22*b* may be manufactured by providing a thin conductive layer made of carbon particles and/or metal particles on the base layer 22*a* and then providing a thin insulation film made of a heat-resistant resin such as polyimide resin on the thin conductive layer. Thus, the thin insulation film is laminated on the thin conductive layer to integrate the thin insulation film with the thin conductive layer.

The carbon particles used in the resistant heat generation layer 22*b* may be known carbon black powder or carbon nanoparticles formed of at least one of carbon nanofiber, carbon nanotube, and carbon microcoil.

The metal particles used in the resistant heat generation layer 22*b* may be silver, aluminum, or nickel particles, and may be granular or filament-shaped.

The insulation layer 22*d* is manufactured by coating the base layer 22*a* with an insulation material including a heat-resistant resin identical to the heat-resistant resin of the base layer 22*a*, such as polyimide resin.

The electrode layer 22*c* is manufactured by coating the base layer 22*a* with a conductive ink or a conductive paste such as silver. Alternatively, metal foil or a metal mesh may be adhered to the base layer 22*a*.

The heat generation sheet 22*s* of the laminated heater 22 is a thin sheet having a small heat capacity, and is heated quickly. An amount of heat generated by the heat generation sheet 22*s* is arbitrarily set according to the volume resistivity of the resistant heat generation layer 22*b*. In other words, the amount of heat generated by the heat generation sheet 22*s* can be adjusted according to the material, shape, size, and dispersion of conductive particles of the resistant heat generation layer 22*b*. For example, the laminated heater 22 providing heat generation per unit area of 35 $W/cm^2$ outputs a total power of about 1,200 W with the heat generation sheet 22*s* having a width of about 20 cm in the axial direction of the fixing sleeve 21 and a length of about 2 cm in the circumferential direction of the fixing sleeve 21, for example.

If a metal filament, such as a stainless steel filament, is used as a laminated heater, the metal filament causes asperities to appear on a surface of the laminated heater. Consequently, when the inner circumferential surface of the fixing sleeve 21 slides over the laminated heater, the asperities of the laminated heater abrade the surface of the laminated heater easily. To address this problem, the heat generation sheet 22*s* has a smooth surface without asperities as described above, improving durability in particular against wear due to sliding of the inner circumferential surface of the fixing sleeve 21 over the laminated heater 22. Further, a surface of the resistant heat generation layer 22*b* of the heat generation sheet 22*s* may be coated with fluorocarbon resin to further improve durability.

In FIG. 4, the heat generation sheet 22*s* of the laminated heater 22 faces the inner circumferential surface of the fixing sleeve 21 in a region in the circumferential direction of the fixing sleeve 21 between a position on the fixing sleeve 21 opposite the nip N via an axis of the fixing sleeve 21 and a position immediately upstream from the nip N in the rotation direction R1 of the fixing sleeve 21. Alternatively, the heat generation sheet 22*s* may extend from the position on the fixing sleeve 21 opposite the nip N to the nip N or face the entire inner circumferential surface of the fixing sleeve 21.

Referring to FIG. 4, the following describes the thermistor 33 used to control a fixing temperature of the fixing device 20 having the above-described structure at which the toner image T is fixed on the recording medium P.

The controller 10, that is, a central processing unit (CPU) with associated memory components, controls the laminated heater 22 based on a detection result provided by the thermistor 33 serving as a temperature detector that detects the temperature of the fixing sleeve 21 so as to adjust the fixing temperature of the fixing device 20, that is, a surface temperature of the fixing sleeve 21 at the nip N.

As illustrated in FIG. 4, the thermistor 33 is disposed downstream from the laminated heater 22 and upstream from the nip formation member 26 in the rotation direction R1 of the fixing sleeve 21. Preferably, the thermistor 33 is disposed near an entry to the nip N, that is, near the nip formation member 26.

The surface temperature of the fixing sleeve 21 near the entry to the nip N detected by the thermistor 33 is substantially equivalent to the surface temperature of the fixing sleeve 21 at the nip N, that is, the fixing temperature of the fixing device 20. Accordingly, with the configuration shown in FIG. 4, the controller 10 controls heat generation of the laminated heater 22 based on the surface temperature of the fixing sleeve 21 detected by the thermistor 33 near the entry to the nip N so that the laminated heater 22 adjusts the surface temperature of the fixing sleeve 21, thus maintaining the fixing temperature of the fixing device 20 at a desired temperature and stabilizing fixing quality of the fixing device 20.

The thermistor 33 faces the inner circumferential surface of the fixing sleeve 21 with or without contacting the inner circumferential surface of the fixing sleeve 21. Accordingly, the thermistor 33 disposed inside the loop formed by the fixing sleeve 21 does not damage the outer circumferential surface of the fixing sleeve 21, preventing the damaged fixing sleeve 21 from degrading the toner image T on the recording medium P. Further, the configuration shown in FIG. 4, in which the thermistor 33 is disposed inside the loop formed by the fixing sleeve 21, allows further downsizing of the fixing device 20 compared to the configuration in which the thermistor 33 is disposed outside the loop formed by the fixing sleeve 21.

Figure 7:
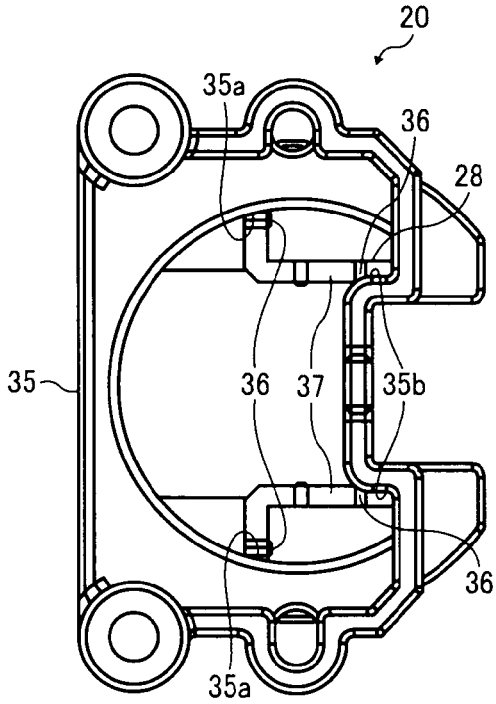
FIG. 7 is a vertical sectional view of a flange and a core holder included in the fixing device shown in FIG. 4.
Figure 8:
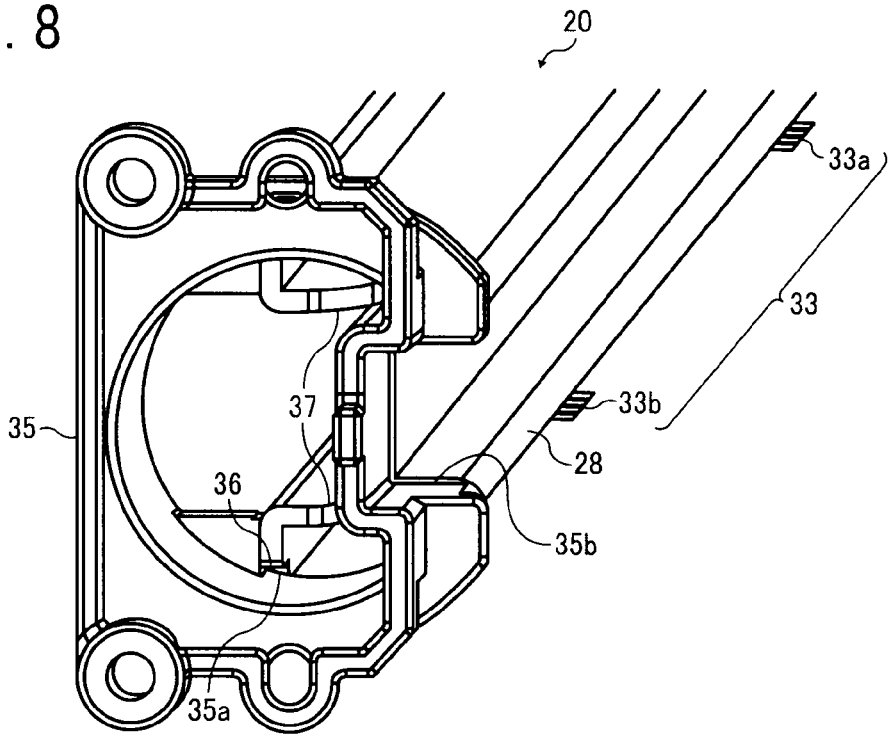
FIG. 8 is a partial perspective view of the flange and the core holder shown in FIG. 7.

Referring to FIGS. 7 and 8, the following describes an exemplary method of attaching the thermistor 33 to the fixing device 20. FIG. 7 is a partial sectional view of the fixing device 20 illustrating the core holder 28 and a flange 35 combined with the core holder 28. FIG. 8 is a partial perspective view of the core holder 28 and the flange 35.

As illustrated in FIGS. 7 and 8, the flange 35 contacts and supports a lateral end of the core holder 28 in the longitudinal direction of the core holder 28 parallel to the axial direction of the fixing sleeve 21. Although not shown in FIGS. 7 and 8, another flange 35 contacts and supports another lateral end of the core holder 28 in the longitudinal direction thereof. FIGS. 7 and 8 illustrate an edge portion of the core holder 28 which is different from that illustrated in FIG. 4. However, the method of attaching the thermistor 33 to the fixing device 20 described below is also applicable to the core holder 28 having the shape illustrated in FIG. 4.

As illustrated in FIG. 8, the thermistor 33 includes a plurality of detection elements, that is, a center thermistor 33*a* and a lateral-end thermistor 33*b* aligned in the longitudinal direction of the core holder 28 parallel to the axial direction of the fixing sleeve 21. Although not shown in FIG. 8, another lateral-end thermistor 33*b* is disposed at another lateral end of the core holder 28 in the longitudinal direction of the core holder 28. For example, in the present embodiment, the center thermistor 33*a* is disposed at a center portion of the core holder 28 and the lateral-end thermistors 33*b* are disposed at lateral end portions of the core holder 28 in the longitudinal direction of the core holder 28 parallel to the axial direction of the fixing sleeve 21. However, the number of detection elements and the positions thereof are not limited to those described above. Moreover, FIG. 8 illustrates the center thermistor 33*a* and one of the lateral-end thermistors 33*b* attached to the core holder 28. Alternatively, the center thermistor 33*a* and the lateral-end thermistors 33*b* may be attached to other components of the fixing device 20. It is to be noted that the term "center portion" in the axial direction of the fixing sleeve 21 corresponds to a narrow conveyance region on the fixing sleeve 21 through which a recording medium P of any size is necessarily conveyed, and that the term "lateral end portions" in the axial direction of the fixing sleeve 21 correspond to a wide conveyance region on the fixing sleeve 21 through which only a large recording medium P having a larger width is conveyed. In other words, a small recording medium P is not conveyed through the lateral end portions in the axial direction of the fixing sleeve 21.

The above-described configuration, in which the plurality of temperature detectors, that is, the center thermistor 33*a* and the lateral-end thermistors 33*b*, is aligned in the axial direction of the fixing sleeve 21, can control heat generation of the laminated heater 22 according to the size of the recording medium P. For example, even when small recording media P pass over the fixing sleeve 21 continuously and therefore only the center portion on the fixing sleeve 21 is cooled by the small recording media P passing thereover, the plurality of temperature detectors detects the temperature differential of the fixing sleeve 21 between the center portion and the lateral end portions of the fixing sleeve 21 in the axial direction thereof, so that the controller 10 controls heat generation of the laminated heater 22 to eliminate the temperature differential of the fixing sleeve 21 in these different portions thereof.

The center thermistor 33*a* and the lateral-end thermistors 33*b* are connected to a drawer connector via a harness that connects the center thermistor 33*a* and the lateral-end thermistors 33*b* to the drawer connector. The harness extends inside the fixing sleeve 21 in the axial direction thereof and is clamped by the flange 35 disposed outside the fixing sleeve 21 and a chassis disposed inside the fixing device 20.

Each of the lateral end portions of the core holder 28 in the longitudinal direction thereof contacts and engages a plurality of engagement portions 35*a* and 35*b* disposed in an inner diametrical surface of the flange 35 mounted on the chassis inside the fixing device 20 so that the flange 35 supports the core holder 28. For example, each of the lateral end portions of the core holder 28 includes slopes 37 and slits 36 disposed in the slopes 37, respectively. The slits 36 of the core holder 28 engage the engagement portions 35*a* and 35*b* of the flange 35, respectively, so that the flange 35 supports the core holder 28.

A first distance between the nip N and one lateral-end thermistor 33*b*, a second distance between the nip N and the center thermistor 33*a*, and a third distance between the nip N and another lateral-end thermistor 33*b* are substantially identical in the rotation direction R1 of the fixing sleeve 21, that is, in the circumferential direction of the fixing sleeve 21. Thus, the center thermistor 33*a* and the lateral-end thermistors 33*b* disposed with respect to the nip N with the identical distance therebetween can provide a uniform amount of heat radiation generated before the fixing sleeve 21 enters the nip N, thus preventing temperature variation in the axial direction of the fixing sleeve 21 due to variation in heat radiation amount.

Figure 9:
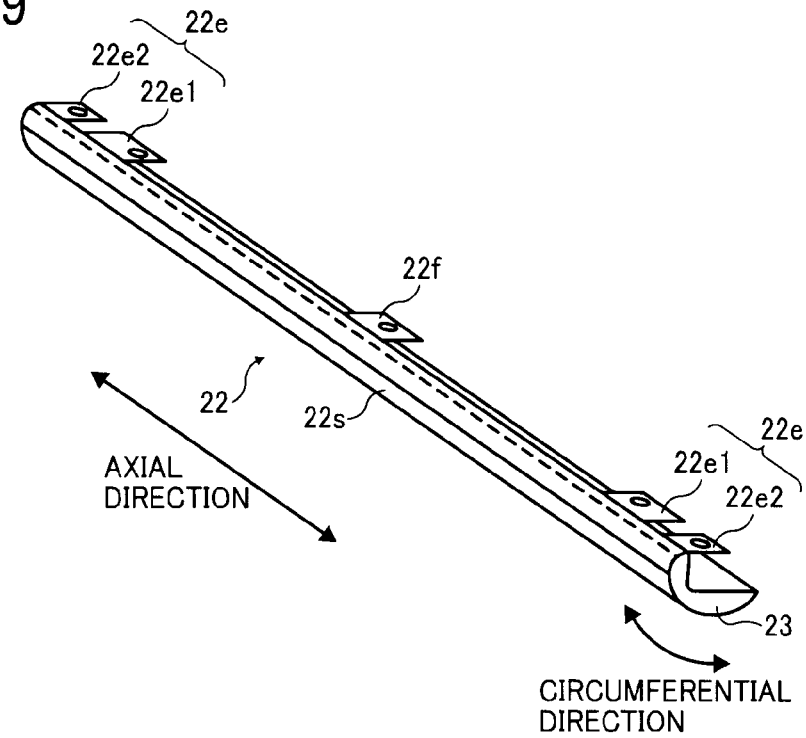
FIG. 9 is a perspective view of the laminated heater shown in FIG. 6 and a heater support included in the fixing device shown in FIG. 4.
Figure 10:
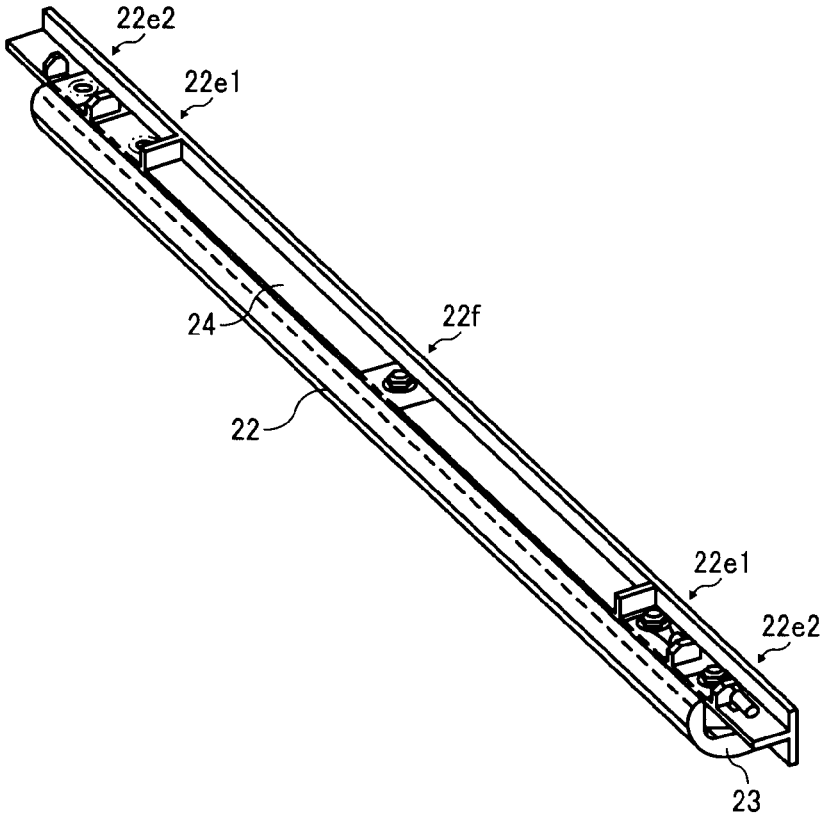
FIG. 10 is a perspective view of the laminated heater shown in FIG. 6, the heater support shown in FIG. 9, and a terminal stay included in the fixing device shown in FIG. 4.
Figure 11:
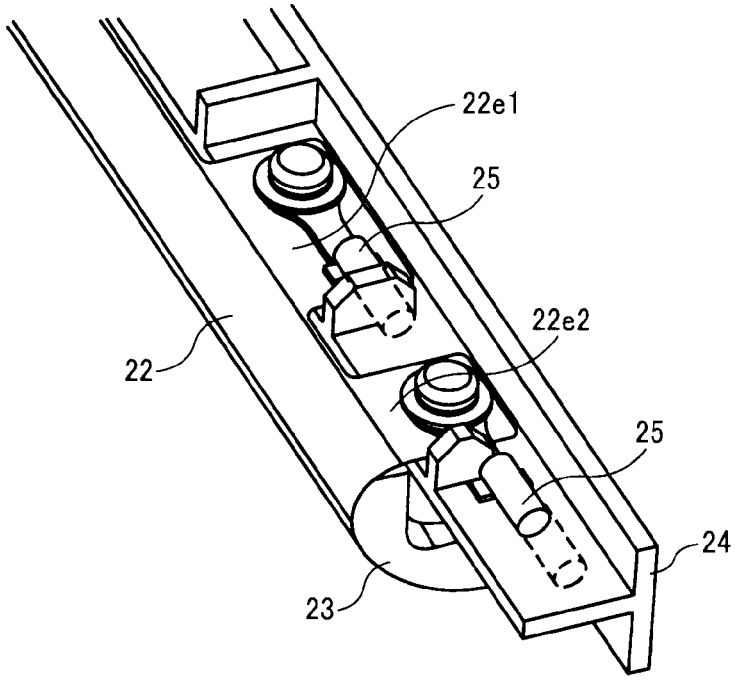
FIG. 11 is a partial perspective view of the laminated heater shown in FIG. 6, the heater support shown in FIG. 9, the terminal stay shown in FIG. 10, and power supply wiring included in the fixing device shown in FIG. 4.
Figure 12:
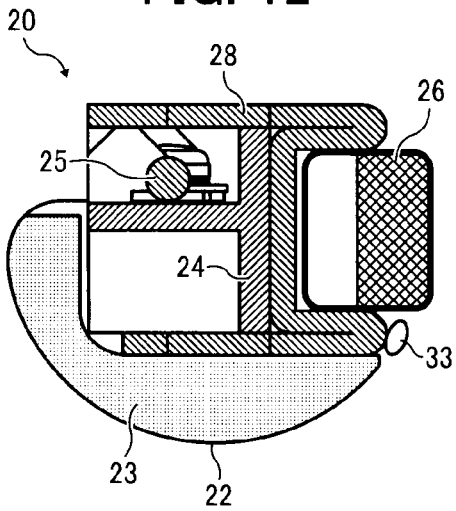
FIG. 12 is a vertical sectional view of the fixing device shown in FIG. 4.

Referring to FIGS. 9 to 12, the following describes assembly processes for assembling the fixing device 20, that is, steps for putting together the components disposed inside the loop formed by the fixing sleeve 21. FIG. 9 is a perspective view of the laminated heater 22 and the heater support 23. FIG. 10 is a perspective view of the laminated heater 22, the heater support 23, and the terminal stay 24. FIG. 11 is a partial perspective view of the laminated heater 22, the heater support 23, the terminal stay 24, and the power supply wiring 25. FIG. 12 is a vertical sectional view of the fixing device 20 illustrating the inner components disposed inside the fixing sleeve 21.

As illustrated in FIG. 9, the laminated heater 22 further includes electrode terminal pairs 22*e* and an attachment terminal 22*f*. The heat generation sheet 22*s* of the laminated heater 22 is adhered to the heater support 23 with an adhesive along the outer circumferential surface of the heater support 23. The adhesive has a small heat conductivity to prevent heat transmission from the heat generation sheet 22*s* to the heater support 23.

The laminated heater 22 includes the electrode terminal pairs 22*e*, each of which includes electrode terminals 22*e*1 and 22*e*2. The electrode terminal pair 22*e* is connected to the electrode layer 22*c* (depicted in FIG. 6) at an edge of the heat generation sheet 22*s* and sends power supplied from the power supply wiring 25 (depicted in FIG. 11) to the electrode layer 22*c*. The plurality of electrode terminal pairs 22*e* is disposed on one end of the heat generation sheet 22*s* in the circumferential direction of the fixing sleeve 21. In FIG. 9, the electrode terminal pairs 22*e* are disposed on an edge of one end of the heat generation sheet 22*s* disposed opposite another end of the heat generation sheet 22*s* disposed closer to the nip N and the pressing roller 31 in the circumferential direction of the fixing sleeve 21. The electrode terminal pair 22*e* including the electrode terminals 22*e*1 and 22*e*2 is disposed on each of lateral ends of the heat generation sheet 22*s* in the axial direction of the fixing sleeve 21.

The following describes the rationales for the above-described arrangement of the electrode terminal pairs 22*e*.

The laminated heater 22 includes at least two electrode terminal pairs 22*e* to supply power to the resistant heat generation layer 22*b* depicted in FIG. 6. For example, when one electrode terminal pair 22*e* is provided on each end of the heat generation sheet 22*s* in the circumferential direction of the fixing sleeve 21, a power source harness for power supply is connected to each electrode terminal pair 22*e*. However, the heat generation sheet 22*s* itself is a thin film with little rigidity. Accordingly, a terminal block that connects the harness to the electrode terminal pair 22*e* must be provided on each end of the heat generation sheet 22*s* in the circumferential direction of the fixing sleeve 21, upsizing the fixing device 20. To address this problem, according to this exemplary embodiment, both of the electrode terminal pairs 22*e* are provided on one end of the heat generation sheet 22*s* in the circumferential direction of the fixing sleeve 21 to downsize the fixing device 20.

Alternatively, the electrode terminal pairs 22*e* may be disposed on one end of the heat generation sheet 22*s* in the axial direction of the fixing sleeve 21. However, when the heat generation sheet 22*s* is attached to the heater support 23 along the outer circumferential surface of the heater support 23, the electrode terminal pairs 22*e* may be bent, resulting in deformation of the electrode terminal pairs 22*e* when the electrode terminal pairs 22*e* are secured with screws, complication of the structure of the electrode terminals 22*e*1 and 22*e*2, and complicated assembly. To address these problems, according to this exemplary embodiment, the plurality of electrode terminal pairs 22*e* is disposed on one end of the heat generation sheet 22*s* in the circumferential direction of the fixing sleeve 21. Accordingly, even when the heat generation sheet 22*s* is attached to the heater support 23 along the outer circumferential surface of the heater support 23, the electrode terminal pairs 22*e* are not bent, facilitating easy and precise assembly processes.

As illustrated in FIG. 9, the heat generation sheet 22*s* near the electrode terminal pairs 22*e* is bent along the edge of the heater support 23 in such a manner that the electrode terminal pairs 22*e* are directed to a center of the circular loop formed by the fixing sleeve 21 depicted in FIG. 4. Then, each of the electrode terminals 22*e*1 and 22*e*2 is connected to the power supply wiring 25 on the terminal stay 24, and secured to the terminal stay 24 as illustrated in FIGS. 10 and 11. For example, the electrode terminals 22*e*1 and 22*e*2 may be secured to the terminal stay 24 with screws, respectively, as illustrated in FIG. 11. As illustrated in FIG. 9, the attachment terminal 22*f* is disposed on and protrudes from a center of the edge of the heat generation sheet 22*s*, that is, the edge on which the electrode terminal pairs 22*e* are disposed, in a longitudinal direction of the laminated heater 22 parallel to the axial direction of the fixing sleeve 21. The attachment terminal 22*f* protrudes from the edge of the heat generation sheet 22*s* and is also secured to the terminal stay 24 with a screw as illustrated in FIG. 10 so as to support the heat generation sheet 22*s*.

As illustrated in FIG. 12, the core holder 28 is attached to the terminal stay 24 in such a manner that the second concave portion of the H-shaped core holder 28 houses the terminal stay 24. Further, the nip formation member 26 is attached to the core holder 28 in such a manner that the first concave portion of the H-shaped core holder 28 houses the nip formation member 26, and the thermistor 33 is attached to the core holder 28 as described above, thus completing assembly of the inner components to be disposed inside the loop formed by the fixing sleeve 21.

Finally, the assembled components are inserted into the loop formed by the fixing sleeve 21 at a position illustrated in FIG. 4, completing assembly of the fixing sleeve 21 and the inner components disposed inside the fixing sleeve 21 of the fixing device 20.

When the heat generation sheet 22*s* is not adhered to the heater support 23 with an adhesive, the electrode terminal pairs 22*e* and the attachment terminal 22*f*, which are disposed at a fixed end of the heat generation sheet 22*s* opposite a free end of the heat generation sheet 22*s* disposed near the nip N in the circumferential direction of the fixing sleeve 21, are secured to the terminal stay 24 with the screws, respectively. The rotating fixing sleeve 21 pulls the free end of the heat generation sheet 22*s* toward the nip N to tension the heat generation sheet 22*s*. Accordingly, the heat generation sheet 22*s* contacts the inner circumferential surface of the fixing sleeve 21 stably in a state in which the heat generation sheet 22*s* is sandwiched between the heater support 23 and the fixing sleeve 21. Consequently, the heat generation sheet 22*s* heats the fixing sleeve 21 effectively.

However, when the heat generation sheet 22*s* is not adhered to the heater support 23 and therefore is levitated from the heater support 23, the fixing sleeve 21 rotating back to allow removal of a jammed recording medium P may lift and shift the heat generation sheet 22*s* from its proper position. Moreover, the moving heat generation sheet 22*s* may twist and deform the electrode terminal pairs 22*e*, breaking them. To address these problems, the heat generation sheet 22*s* is preferably adhered to the heater support 23 to prevent the heat generation sheet 22*s* from shifting from the proper position.

Conversely, when an entire inner surface of the heat generation sheet 22*s* facing the heater support 23 is adhered to the heater support 23, heat generated by the heat generation sheet 22*s* moves from the entire inner surface of the heat generation sheet 22*s* to the heater support 23 easily. To address this problem, lateral end portions of the heat generation sheet 22*s* in the axial direction of the fixing sleeve 21, which correspond to non-conveyance regions on the fixing sleeve 21 through which the recording medium P is not conveyed, are adhered to the heater support 23 to prevent the heat generation sheet 22*s* from shifting from the proper position. Further, a center portion of the heat generation sheet 22*s* in the axial direction of the fixing sleeve 21, which corresponds to a conveyance region on the fixing sleeve 21 through which the recording medium P is conveyed, that is, a maximum conveyance region corresponding to a width of the maximum recording medium P, is not adhered to the heater support 23 and therefore is isolated from the heater support 23. Accordingly, heat is not transmitted from the center portion of the heat generation sheet 22*s* in the axial direction of the fixing sleeve 21 to the heater support 23. As a result, heat generated at the center portion of the heat generation sheet 22*s* is used effectively to heat the fixing sleeve 21.

The heat generation sheet 22*s* may be adhered to the heater support 23 with a liquid adhesive for coating. Alternatively, a tape adhesive (e.g., a double-faced adhesive tape), which provides adhesion on both sides thereof and includes a heat-resistant acryl or silicon material, may be used. Accordingly, the laminated heater 22 (e.g., the heat generation sheet 22*s*) is adhered to the heater support 23 easily. Further, if the laminated heater 22 malfunctions, the laminated heater 22 can be replaced easily by peeling off the double-faced adhesive tape, facilitating maintenance.

It is to be noted that, if the heat generation sheet 22*s* and the heater support 23 merely sandwich the double-faced adhesive tape, the lateral end portions of the heat generation sheet 22*s* in the axial direction of the fixing sleeve 21, which are adhered to the heater support 23, are lifted by a thickness of the double-faced adhesive tape. Accordingly, the center portion of the heat generation sheet 22*s* in the axial direction of the fixing sleeve 21, which is not adhered to the heater support 23, does not contact the fixing sleeve 21 uniformly, decreasing heating efficiency for heating the fixing sleeve 21 and varying temperature distribution of the fixing sleeve 21 in the axial direction of the fixing sleeve 21.

Figure 13:
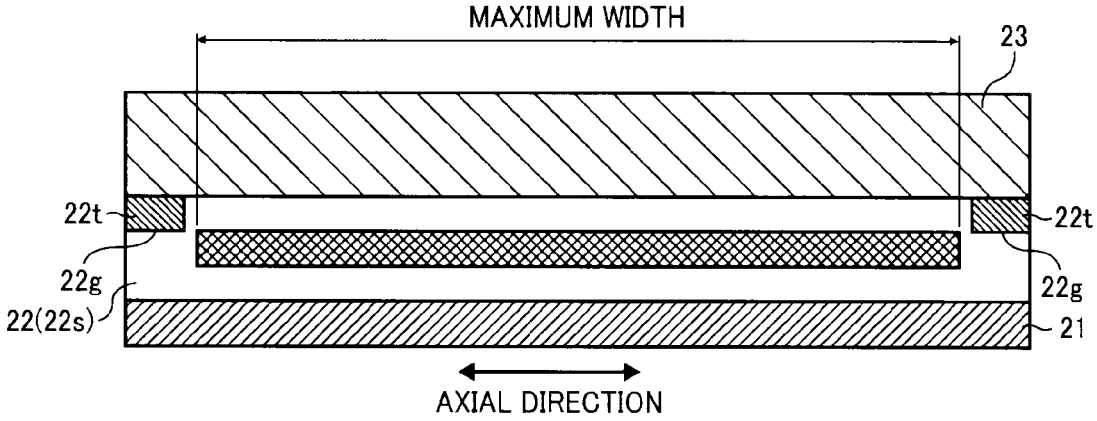
FIG. 13 is a horizontal sectional view of the heater support shown in FIG. 9, the laminated heater shown in FIG. 6, and the fixing sleeve shown in FIG. 5A illustrating edge grooves included in the laminated heater.

To address this problem, the lateral end portions of the heat generation sheet 22*s* in the axial direction of the fixing sleeve 21, which are adhered to the heater support 23 with the double-faced adhesive tape, have a thickness decreased by the thickness of the double-faced adhesive tape. Referring to FIG. 13, the following describes the configuration of the heat generation sheet 22*s* having the decreased thickness partially.

FIG. 13 is a horizontal sectional view of the heater support 23, the laminated heater 22, and the fixing sleeve 21. As illustrated in FIG. 13, the laminated heater 22 further includes edge grooves 22*g* and double-faced adhesive tapes 22*t*. The edge grooves 22*g* are disposed at lateral edges, which correspond to the non-conveyance regions on the fixing sleeve 21 through which the recording medium P is not conveyed, of the heat generation sheet 22*s* in the axial direction of the fixing sleeve 21, respectively, on a surface of the base layer 22*a* (depicted in FIG. 6) of the heat generation sheet 22*s* that faces the heater support 23, and extend in the circumferential direction of the fixing sleeve 21. Each of the edge grooves 22*g* has a depth equivalent to the thickness (e.g., about 0.1 mm) of the double-faced adhesive tape 22*t*. The double-faced adhesive tapes 22*t* are adhered to the edge grooves 22*g* of the heat generation sheet 22*s*, respectively, and then adhered to the heater support 23. In other words, the heat generation sheet 22*s* is adhered to the heater support 23 at predetermined positions on the heater support 23 via the double-faced adhesive tapes 22*t*. Accordingly, when the heat generation sheet 22*s* is adhered to the heater support 23, a surface of the heat generation sheet 22*s* that faces the fixing sleeve 21 is planar in the axial direction of the fixing sleeve 21. Consequently, the heat generation sheet 22*s* uniformly contacts the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction thereof.

Figure 14:
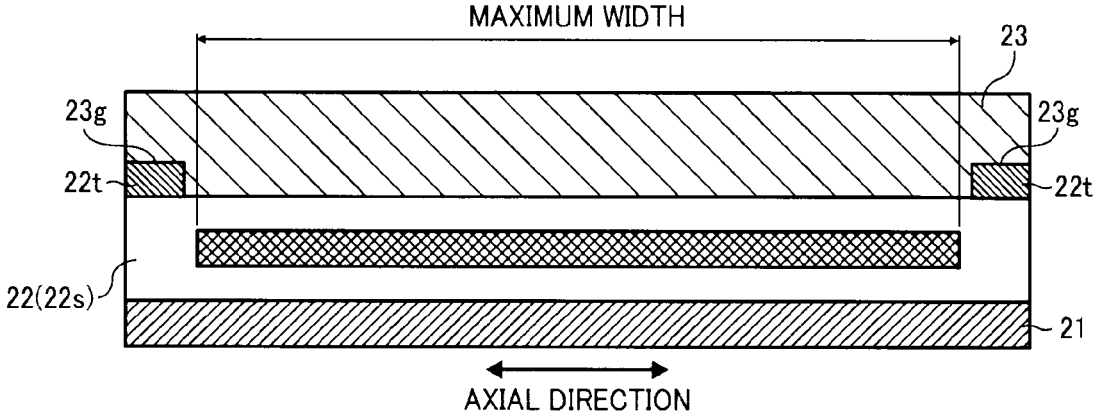
FIG. 14 is a horizontal sectional view of the heater support shown in FIG. 9, the laminated heater shown in FIG. 6, and the fixing sleeve shown in FIG. 5A illustrating edge grooves included in the heater support.

Alternatively, edge grooves may be provided in the heater support 23 instead of in the heat generation sheet 22*s*. FIG. 14 is a horizontal sectional view of the heater support 23, the laminated heater 22, and the fixing sleeve 21. As illustrated in FIG. 14, the heater support 23 includes edge grooves 23*g*.

The edge grooves 23*g* are provided at lateral edges of the heater support 23 in the axial direction of the fixing sleeve 21, which correspond to the non-conveyance regions on the fixing sleeve 21 through which the recording medium P is not conveyed, on a surface of the heater support 23 that faces the heat generation sheet 22*s*, and extend in the circumferential direction of the fixing sleeve 21. Each of the edge grooves 23*g* has a depth equivalent to the thickness of the double-faced adhesive tape 22*t*. The double-faced adhesive tapes 22*t* are adhered to the edge grooves 23*g* of the heater support 23, respectively, and then the heat generation sheet 22*s* is adhered to the heater support 23 via the double-faced adhesive tapes 22*t*. Accordingly, when the heat generation sheet 22*s* is adhered to the heater support 23, the surface of the heat generation sheet 22*s* that faces the fixing sleeve 21 is planar in the axial direction of the fixing sleeve 21. Consequently, the heat generation sheet 22*s* uniformly contacts the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction thereof.

Referring to FIGS. 3 and 4, the following describes operation of the fixing device 20 having the above-described structure.

When the image forming apparatus 1 receives an output signal, for example, when the image forming apparatus 1 receives a print request specified by a user by using a control panel or a print request sent from an external device, such as a client computer, the pressing roller 31 is pressed against the nip formation member 26 via the fixing sleeve 21 to form the nip N between the pressing roller 31 and the fixing sleeve 21.

Thereafter, a driver drives and rotates the pressing roller 31 clockwise in FIG. 4 in the rotation direction R2. Accordingly, the fixing sleeve 21 rotates counterclockwise in FIG. 4 in the rotation direction R1 in accordance with rotation of the pressing roller 31. The laminated heater 22 supported by the heater support 23 contacts the inner circumferential surface of the fixing sleeve 21, and the fixing sleeve 21 slides over the laminated heater 22.

Simultaneously, an external power source or an internal capacitor supplies power to the laminated heater 22 via the power supply wiring 25 to cause the heat generation sheet 22*s* to generate heat. The heat generated by the heat generation sheet 22*s* is transmitted effectively to the fixing sleeve 21 contacting the heat generation sheet 22*s*, so that the fixing sleeve 21 is heated quickly.

Alternatively, heating of the fixing sleeve 21 by the laminated heater 22 may not start simultaneously with driving of the pressing roller 31 by the driver. In other words, the laminated heater 22 may start heating the fixing sleeve 21 at a time different from a time at which the driver starts driving the pressing roller 31. As described above, the controller 10 controls heat generation of the laminated heater 22 based on the temperature of the fixing sleeve 21 detected by the thermistor 33 so that the nip N is heated to a predetermined temperature desirable for fixing the toner image T on the recording medium P. After the fixing sleeve 21 is heated to the predetermined temperature, the recording medium P bearing the toner image T is conveyed to the nip N while the predetermined temperature is maintained.

In the fixing device 20 described above, the fixing sleeve 21 and the laminated heater 22 have a small heat capacity, shortening a warm-up time and a first print time of the fixing device 20 while saving energy. Further, the heat generation sheet 22*s* is a resin sheet. Accordingly, even when rotation and vibration of the pressing roller 31 applies stress to the heat generation sheet 22*s* repeatedly, and bends the heat generation sheet 22*s* repeatedly, the heat generation sheet 22*s* is not broken due to wear, and the fixing device 20 operates for a longer time.

When the image forming apparatus 1 does not receive an output signal, the pressing roller 31 and the fixing sleeve 21 do not rotate and power is not supplied to the laminated heater 22 to save energy. However, in order to restart the fixing device 20 immediately after the image forming apparatus 1 receives an output signal, power can be supplied to the laminated heater 22 while the pressing roller 31 and the fixing sleeve 21 do not rotate. For example, power in an amount sufficient to keep the entire fixing sleeve 21 warm is supplied to the laminated heater 22.

Referring to FIGS. 15A, 15B, 16, 17, and 18, the following describes variations of the heat generation sheet 22*s* of the laminated heater 22.

In the heat generation sheet 22*s* depicted in FIG. 6, the resistant heat generation layer 22*b* is provided on the entire surface or a part of the surface of the base layer 22*a*. Alternatively, the resistant heat generation layer 22*b* may be divided among a plurality of regions zoned arbitrarily on the surface of the base layer 22*a* in such a manner that each resistant heat generation layer 22*b* generates heat independently.

FIG. 15A is a plan view of a laminated heater 22U as a first variation of the laminated heater 22. As illustrated in FIG. 15A, the laminated heater 22U, serving as a heat generator, includes a heat generation sheet 22*s*U. The heat generation sheet 22*s*U includes resistant heat generation layers 22*b*1 and 22*b*2, the electrode layers 22*c*, the insulation layers 22*d*, which are disposed on the base layer 22*a* (depicted in FIG. 6), and the electrode terminal pairs 22*e* disposed on an edge of the heat generation sheet 22*s*U.

FIG. 15A is a plan view of the laminated heater 22U spread on a flat surface before the laminated heater 22U is adhered to the heater support 23 depicted in FIG. 4. A horizontal direction in FIG. 15A is a width direction of the laminated heater 22U parallel to the axial direction of the fixing sleeve 21. A vertical direction in FIG. 15A is a circumferential direction of the laminated heater 22U parallel to the circumferential direction of the fixing sleeve 21.

As illustrated in FIG. 15A, the heat generation sheet 22*s*U is divided into three regions on a surface of the heat generation sheet 22*s*U in a width direction of the heat generation sheet 22*s*U parallel to the axial direction of the fixing sleeve 21. Further, the heat generation sheet 22*s*U is divided into two regions on the surface of the heat generation sheet 22*s*U in a circumferential direction of the heat generation sheet 22*s*U and the fixing sleeve 21. Thus, in total, the heat generation sheet 22*s*U is divided into six regions.

FIG. 15B is a lookup table of a matrix with two rows in the circumferential direction of the fixing sleeve 21 and three columns in the axial direction of the fixing sleeve 21, referred to as a 2-by-3 array of 6 elements corresponding to the six regions. The resistant heat generation layer 22*b*1 having a predetermined width and length is provided in the element (1, 2) corresponding to the region provided at a lower center portion of the heat generation sheet 22*s*U in FIG. 15A in the axial direction of the fixing sleeve 21. The resistant heat generation layers 22*b*2 having a predetermined width and length are provided in the elements (2, 1) and (2, 3) corresponding to the regions provided at upper lateral end portions of the heat generation sheet 22*s*U in FIG. 15A in the axial direction of the fixing sleeve 21, respectively.

The electrode layers 22*c* connected to the resistant heat generation layer 22*b*1 are provided in the elements (1, 1) and (1, 3) corresponding to the regions provided at lower lateral end portions of the heat generation sheet 22*s*U in FIG. 15A in the axial direction of the fixing sleeve 21, respectively. Each of the electrode layers 22*c* is connected to the electrode terminal 22*e*1 that protrudes from one edge, that is, a lower edge in FIG. 15A, of the heat generation sheet 22*s*U, forming a first heat generation circuit.

The electrode layer 22*c* connected to and sandwiched between the two resistant heat generation layers 22*b*2 is provided in the element (2, 2) corresponding to the region provided at an upper center portion of the heat generation sheet 22*s*U in FIG. 15A in the axial direction of the fixing sleeve 21. Each of the two resistant heat generation layers 22*b*2 is connected to the electrode layer 22*c* that extends to the lower edge of the heat generation sheet 22*s*U in FIG. 15A in the circumferential direction of the heat generation sheet 22*s*U. Each of the electrode layers 22*c* is connected to the electrode terminal 22*e*2 that protrudes from the lower edge of the heat generation sheet 22*s*U, forming a second heat generation circuit.

The insulation layer 22*d* is provided between the first heat generation circuit and the second heat generation circuit to prevent a short circuit of the first heat generation circuit and the second heat generation circuit.

In the laminated heater 22U having the above-described configuration, when the electrode terminals 22*e*1 supply power to the heat generation sheet 22*s*U, internal resistance of the resistant heat generation layer 22*b*1 generates Joule heat. By contrast, the electrode layers 22*c* do not generate heat due to their low resistance. Accordingly, only the region of the heat generation sheet 22*s*U shown by the element (1, 2) heats the center portion of the fixing sleeve 21 in the axial direction thereof.

On the other hand, when the electrode terminals 22*e*2 supply power to the heat generation sheet 22*s*U, internal resistance of the resistant heat generation layers 22*b*2 generates Joule heat. By contrast, the electrode layers 22*c* do not generate heat due to their low resistance. Accordingly, only the regions of the heat generation sheet 22*s*U shown by the elements (2, 1) and (2, 3), respectively, heat the lateral end portions of the fixing sleeve 21 in the axial direction thereof.

When a small size recording medium P having a small width passes through the fixing device 20, power is supplied to the electrode terminals 22*e*1 to cause only a center portion of the heat generation sheet 22*s*U to generate heat that is transmitted to the center portion of the fixing sleeve 21 in the axial direction thereof. By contrast, when a large size recording medium P having a large width passes through the fixing device 20, power is supplied to the electrode terminals 22*e*1 and 22*e*2 to cause the heat generation sheet 22*s*U to generate heat that is transmitted to the fixing sleeve 21 throughout the entire width thereof in the axial direction of the fixing sleeve 21. Thus, the fixing device 20 provides desired fixing according to the width of the recording medium P with reduced energy consumption.

The controller 10 depicted in FIG. 4 controls an amount of heat generated by the laminated heater 22U according to the size of the recording medium P. Accordingly, even when the small size recording media P pass through the fixing device 20 continuously, the lateral end portions of the heat generation sheet 22*s*U corresponding to the non-conveyance regions of the fixing sleeve 21 over which the recording medium P is not conveyed, respectively, are not overheated, thus preventing stoppage of the fixing device 20 to protect the components of the fixing device 20 and decrease of productivity of the fixing device 20. The single, divided laminated heater 22U provides varied regions of the heat generation sheet 22*s*U, reducing temperature variation of the laminated heater 22U in the axial direction of the fixing sleeve 21 compared to a plurality of separate, laminated heaters.

Edges of each of the resistant heat generation layers 22*b*1 and 22*b*2 contacting the insulation layers 22*d* or the electrode layers 22*c* which have a relatively high heat conductivity generate a smaller amount of heat due to heat transmission from the resistant heat generation layers 22*b*1 and 22*b*2 to the insulation layers 22*d* or the electrode layers 22*c*. Accordingly, in the configuration illustrated in FIG. 15A in which a border between the center, resistant heat generation layer 22*b*1 and the adjacent electrode layer 22*c* and a border between the lateral, resistant heat generation layer 22*b*2 and the adjacent electrode layer 22*c* are provided on an identical face, when power is supplied to the electrode terminals 22*e*1 and 22*e*2, such borders have a decreased temperature, varying temperature distribution of the laminated heater 22U in the axial direction of the fixing sleeve 21. As a result, a faulty toner image is formed due to faulty fixing.

Figure 17:
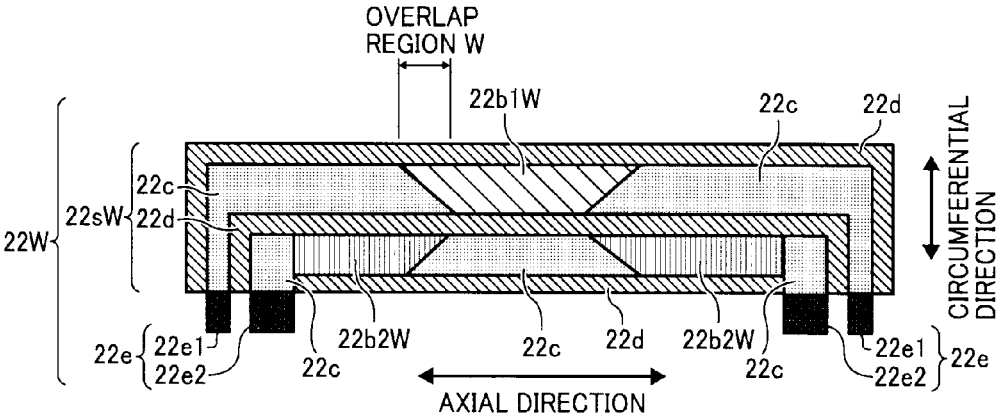
FIG. 17 is a plan view of a laminated heater as a third variation of the laminated heater shown in FIG. 6.

To address this problem, variations of the laminated heater 22 shown in FIGS. 16 and 17 can be used in the fixing device 20. FIG. 16 illustrates a laminated heater 22V as a second variation of the laminated heater 22. FIG. 16 is a plan view of the laminated heater 22V. As illustrated in FIG. 16, the laminated heater 22V, serving as a heat generator, includes a heat generation sheet 22*s*V. The heat generation sheet 22*s*V includes a resistant heat generation layer 22*b*1V replacing the resistant heat generation layer 22*b*1 depicted in FIG. 15A.

The basic configuration of the laminated heater 22V is identical to that of the laminated heater 22U depicted in FIG. 15A. However, the laminated heater 22V is different from the laminated heater 22U in that the resistant heat generation layer 22*b*1V has a longer width in the axial direction of the fixing sleeve 21. Accordingly, the resistant heat generation layer 22*b*1V partially overlaps each of the resistant heat generation layers 22*b*2 in a width direction of the heat generation sheet 22*s*V parallel to the axial direction of the fixing sleeve 21, to form an overlap region V. Accordingly, when power is supplied to the electrode terminals 22*e*1 and 22*e*2, temperature decrease is prevented at a border between the resistant heat generation layer 22*b*1V and the adjacent electrode layer 22*c* and a border between the resistant heat generation layer 22*b*2 and the adjacent electrode layer 22*c*.

FIG. 17 is a plan view of a laminated heater 22W as a third variation of the laminated heater 22. As illustrated in FIG. 17, the laminated heater 22W, serving as a heat generator, includes a heat generation sheet 22*s*W. The heat generation sheet 22*s*W includes resistant heat generation layers 22*b*1W and 22*b*2W replacing the resistant heat generation layers 22*b*1V and 22*b*2 depicted in FIG. 16, respectively.

The basic structure of the laminated heater 22W is identical to that of the laminated heater 22V depicted in FIG. 16. However, the laminated heater 22W is different from the laminated heater 22V in that the resistant heat generation layer 22*b*1W partially overlaps each of the resistant heat generation layers 22*b*2W to form an overlap region W. In each overlap region W, a border between the resistant heat generation layer 22*b*1W and the adjacent electrode layer 22*c* is tapered with respect to a circumferential direction of the heat generation sheet 22*s*W in a direction opposite a direction in which a border between the resistant heat generation layer 22*b*2W and the adjacent electrode layer 22*c* is tapered with respect to the circumferential direction of the heat generation sheet 22*s*W. Thus, an amount of overlap of the resistant heat generation layer 22*b*1W and the resistant heat generation layer 22*b*2W is adjusted.

With the configuration shown in FIG. 16, a width of the overlap region V in which the resistant heat generation layer 22*b*1V overlaps the resistant heat generation layer 22*b*2 in the width direction of the heat generation sheet 22*s*V parallel to the axial direction of the fixing sleeve 21, is unchanged. Accordingly, if the width of the overlap region V varies, an amount of heat generated by the heat generation sheet 22*s*V varies. To address this problem, with the configuration shown in FIG. 17, the width of the overlap region W changes in the circumferential direction of the heat generation sheet 22*s*W. For example, the width of the overlap region W of the resistant heat generation layer 22*b*1W and the width of the overlap region W of the resistant heat generation layer 22*b*2W decrease at a predetermined rate in a downward direction in FIG. 17. Accordingly, heat generation distribution is adjusted to reduce adverse effects of production errors of the laminated heater 22W. As a result, the laminated heater 22W provides uniform temperature throughout the axial direction of the fixing sleeve 21.

Referring to FIGS. 15A, 16, and 17, the following describes a method of manufacturing the heat generation sheets 22*s*U, 22*s*V, and 22*s*W. In the laminated heater 22U depicted in FIG. 15A, portions on the surface of the base layer 22*a* on which the resistant heat generation layers 22*b*1 and 22*b*2 are to be disposed are exposed and coated to form the resistant heat generation layers 22*b*1 and 22*b*2. Then, portions on the surface of the base layer 22*a* on which the insulation layers 22*d* are to be disposed are exposed and coated to form the insulation layers 22*d* made of heat-resistant resin. Thereafter, portions on the surface of the base layer 22*a* on which the electrode layers 22*c* are to be disposed are exposed and coated with a conductive paste to form the electrode layers 22*c*. In other words, exposure of the portions on the surface of the base layer 22*a* on which the resistant heat generation layers 22*b*1 and 22*b*2 are to be disposed is adjusted to form the resistant heat generation layers 22*b*1 and 22*b*2 having an arbitrary shape. Similarly, the resistant heat generation layers 22*b*1V and 22*b*2 of the laminated heater 22V depicted in FIG. 16 and the resistant heat generation layers 22*b*1W and 22*b*2W of the laminated heater 22W depicted in FIG. 17 are formed.

Figure 18:
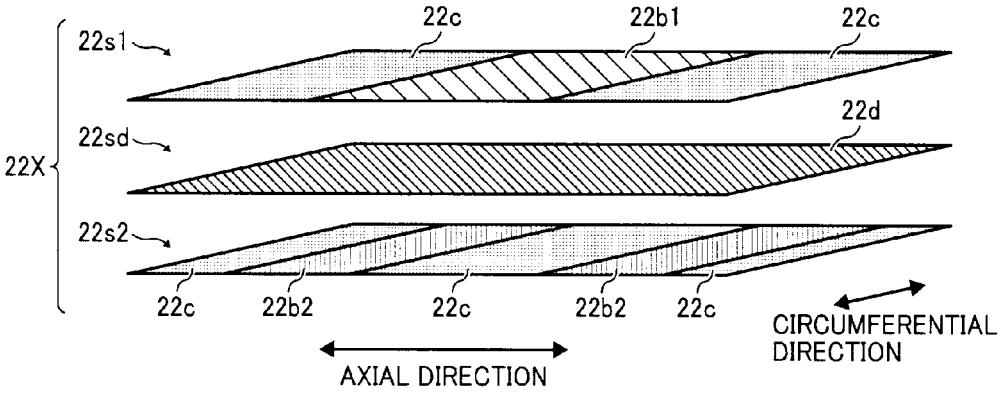
FIG. 18 is an exploded perspective view of a laminated heater as a fourth variation of the laminated heater shown in FIG. 6.

The laminated heater (e.g., the laminated heater 22, 22U, 22V, or 22W) may include a plurality of layered heat generation sheets in each of which one or more resistant heat generation layers are provided on an arbitrary portion on the surface of the base layer 22*a* in such a manner that the resistant heat generation layers generate heat independently from each other. FIG. 18 illustrates a laminated heater 22X including a plurality of heat generation sheets as a fourth variation of the laminated heater 22.

FIG. 18 is an exploded perspective view of the laminated heater 22X. As illustrated in FIG. 18, the laminated heater 22X, serving as a heat generator, includes a first heat generation sheet 22*s*1, an insulation sheet 22*sd*, and a second heat generation sheet 22*s*2. The first heat generation sheet 22*s*1 includes the resistant heat generation layer 22*b*1 and the electrode layers 22*c*. The insulation sheet 22*sd* includes the insulation layer 22*d*. The second heat generation sheet 22*s*2 includes the resistant heat generation layers 22*b*2 and the electrode layers 22*c*. The first heat generation sheet 22*s*1 is disposed on the insulation sheet 22*sd* disposed on the second heat generation sheet 22*s*2.

The first heat generation sheet 22*s*1 is divided into three regions on a surface thereof in a width direction of the first heat generation sheet 22*s*1 parallel to the axial direction of the fixing sleeve 21. The resistant heat generation layer 22*b*1 is provided in a center region on the surface of the first heat generation sheet 22*s*1. The electrode layers 22*c*, which are connected to the adjacent resistant heat generation layer 22*b*1, are provided in lateral end regions on the surface of the first heat generation sheet 22*s*1, respectively.

The second heat generation sheet 22*s*2 is divided into five regions on a surface thereof in a width direction of the second heat generation sheet 22*s*2 parallel to the axial direction of the fixing sleeve 21. The resistant heat generation layers 22*b*2 are provided in the second and fourth regions from left to right in FIG. 18, respectively. The electrode layers 22*c*, which are connected to the adjacent resistant heat generation layers 22*b*2, are provided in the first, third, and fifth regions from left to right in FIG. 18, respectively.

The first heat generation sheet 22*s*1 is provided on the second heat generation sheet 22*s*2 via the insulation sheet 22*sd* in such a manner that the first heat generation sheet 22*s*1 and the second heat generation sheet 22*s*2 sandwich the insulation sheet 22*sd*. Thus, an independent first heat generation circuit is provided in the first heat generation sheet 22*s*1, and another independent second heat generation circuit is provided in the second heat generation sheet 22*s*2.

When power is supplied to the first heat generation circuit, internal resistance of the resistant heat generation layer 22*b*1 generates Joule heat, and a center region on the surface of the first heat generation sheet 22*s*1 in the width direction of the first heat generation sheet 22*s*1 generates heat to be transmitted to the center portion of the fixing sleeve 21 in the axial direction of the fixing sleeve 21. When power is supplied to the second heat generation circuit, internal resistance of the resistant heat generation layers 22*b*2 generates Joule heat, and lateral end regions on the surface of the second heat generation sheet 22*s*2 in the width direction of the second heat generation sheet 22*s*2 generate heat to be transmitted to the lateral end portions of the fixing sleeve 21 in the axial direction of the fixing sleeve 21.

If the laminated heater 22X is divided in a circumferential direction of the laminated heater 22× as in the laminated heaters 22U, 22V, and 22W depicted in FIGS. 15A, 16, and 17, respectively, the laminated heater 22X needs to have an increased area to provide a desired heat generation amount, and therefore is not installed inside the small fixing sleeve 21 having a small diameter. To address this problem, the laminated heater 22X includes the plurality of heat generation sheets layered in a thickness direction, that is, the second heat generation sheet 22*s*2 and the first heat generation sheet 22*s*1 provided on the second heat generation sheet 22*s*2 in such a manner that the resistant heat generation layer 22*b*1 of the first heat generation sheet 22*s*1 is shifted from the resistant heat generation layers 22*b*2 of the second heat generation sheet 22*s*2 in a width direction of the laminated heater 22X as illustrated in FIG. 18. Accordingly, the laminated heater 22X provides varied heat generation distribution in the axial direction of the fixing sleeve 21 like the laminated heaters 22U, 22V, and 22W depicted in FIGS. 15A, 16, and 17, respectively, providing an increased output of heat while saving space and downsizing the fixing device 20.

As illustrated in FIG. 4, when the fixing sleeve 21 rotates, the pressing roller 31 pulls the fixing sleeve 21 at the nip N. Accordingly, the pressing roller 31 applies tension to an upstream portion of the fixing sleeve 21 provided upstream from the nip N in the rotation direction R1 of the fixing sleeve 21. Consequently, the inner circumferential surface of the fixing sleeve 21 slides over the laminated heater 22 in a state in which the fixing sleeve 21 is pressed against the heater support 23. By contrast, the pressing roller 31 does not apply tension to a downstream portion of the fixing sleeve 21 provided downstream from the nip N in the rotation direction R1 of the fixing sleeve 21. Accordingly, the downstream portion of the fixing sleeve 21 remains slack, a situation that is exacerbated if the fixing sleeve 21 rotates faster and destabilizing the rotation of the fixing sleeve 21.

To address this problem, the fixing device 20 may include a fixing member support provided inside the loop formed by the fixing sleeve 21 to support at least the downstream portion of the fixing sleeve 21. FIGS. 19A, 19B, 19C, 19D, and 19E illustrate such fixing member support.

Figure 19A:
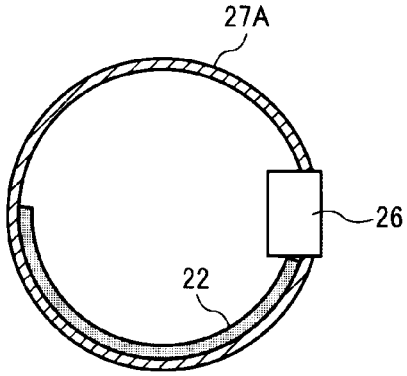
FIG. 19A is a vertical sectional view of a fixing sleeve support, a laminated heater, and a nip formation member included in the fixing device shown in FIG. 4 illustrating the laminated heater provided inside the fixing sleeve support.

FIG. 19A is a vertical sectional view of a fixing sleeve support 27A, the laminated heater 22, and the nip formation member 26. The fixing sleeve support 27A is a metal member serving as a fixing member support that supports the fixing sleeve 21 depicted in FIG. 4 serving as a fixing member, for example, a thin, stainless steel pipe. The laminated heater 22 is provided on an inner circumferential surface of the fixing sleeve support 27A, and an outer circumferential surface of the fixing sleeve support 27A supports the fixing sleeve 21, providing stable rotation of the fixing sleeve 21. Further, the rigid, metal fixing sleeve support 27A supports the fixing sleeve 21, facilitating assembly of the fixing device 20. The fixing sleeve 21 does not slide over the laminated heater 22 by contacting the laminated heater 22, preventing wear of a protective layer (e.g., a sliding layer) and an insulation layer disposed on a surface of the laminated heater 22 which may be caused by the fixing sleeve 21 sliding over the laminated heater 22. Accordingly, electric conductors, such as the resistant heat generation layers 22*b* and the electrode layers 22*c*, are not exposed, preventing short circuiting. However, the metal fixing sleeve support 27A has a substantial heat capacity, providing a slower speed at which the temperature of the fixing sleeve 21 increases during warm-up than the structure shown in FIG. 4 that does not include the fixing sleeve support 27A.

Figure 19B:
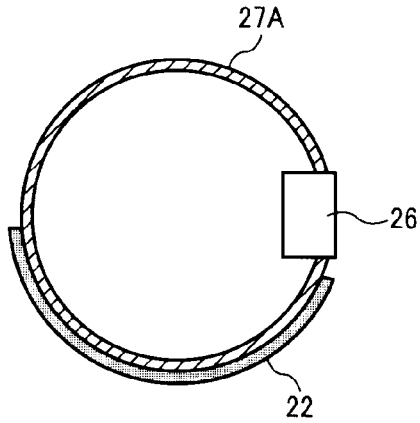
FIG. 19B is a vertical sectional view of a fixing sleeve support, a laminated heater, and a nip formation member included in the fixing device shown in FIG. 4 illustrating the laminated heater provided outside the fixing sleeve support.

FIG. 19B is a vertical sectional view of the fixing sleeve support 27A, the laminated heater 22, and the nip formation member 26 as a variation of the structure shown in FIG. 19A. As illustrated in FIG. 19B, the laminated heater 22 is disposed on the outer circumferential surface of the fixing sleeve support 27A to transmit heat to the fixing sleeve 21 more quickly than the laminated heater 22 provided on the inner circumferential surface of the fixing sleeve support 27A shown in FIG. 19A. However, heat is adversely transmitted from an inner circumferential surface of the laminated heater 22 facing the fixing sleeve support 27A to the fixing sleeve support 27A.

Figure 19C:
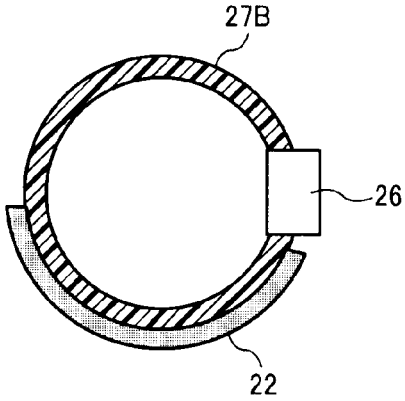
FIG. 19C is a vertical sectional view of a fixing sleeve support as one variation of the fixing sleeve support shown in FIG. 19B.

To address this problem, the fixing device 20 may include a fixing sleeve support 27B, instead of the fixing sleeve support 27A, which has a heat conductivity smaller than that of the metal fixing sleeve support 27A as in FIG. 19C. FIG. 19C is a vertical sectional view of the fixing sleeve support 27B, the laminated heater 22, and the nip formation member 26. The fixing sleeve support 27B, serving as a fixing member support that supports the fixing sleeve 21 depicted in FIG. 4 serving as a fixing member, includes solid resin having a heat conductivity smaller than that of the metal fixing sleeve support 27A, suppressing heat transmission from the inner circumferential surface of the laminated heater 22 facing the fixing sleeve support 27B to the fixing sleeve support 27B. However, a heat resistance of resin is generally smaller than that of metal, and resin having a high heat resistance is expensive, resulting in increased manufacturing costs.

Figure 19D:
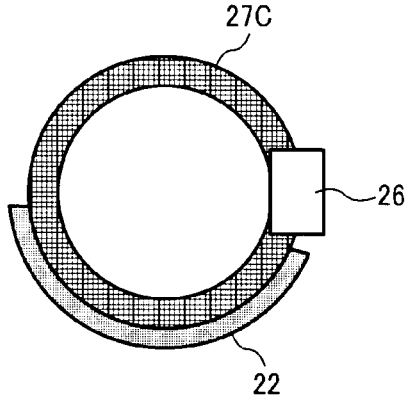
FIG. 19D is a vertical sectional view of a fixing sleeve support as another variation of the fixing sleeve support shown in FIG. 19B.

To address this problem, the fixing device 20 may include a fixing sleeve support 27C instead of the fixing sleeve support 27B. The fixing sleeve support 27C is made of polyimide resin foam that provides heat insulation and rigidity. FIG. 19D is a vertical sectional view of the fixing sleeve support 27C, the laminated heater 22, and the nip formation member 26. The fixing sleeve support 27C serves as a fixing member support that supports the fixing sleeve 21 depicted in FIG. 4 serving as a fixing member.

Figure 19E:
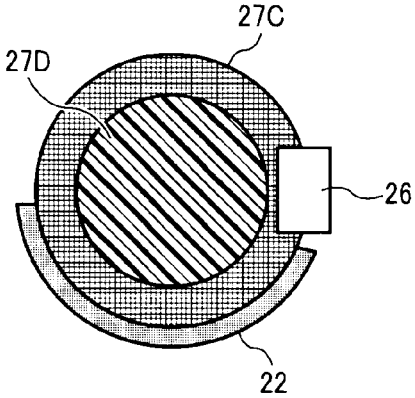
FIG. 19E is a vertical sectional view of a resin support provided inside the fixing sleeve support shown in FIG. 19D.

FIG. 19E is a vertical sectional view of the fixing sleeve support 27C, the laminated heater 22, the nip formation member 26, and a resin member 27D for enhanced rigidity. The resin member 27D is made of polyimide foam, and is accessorily disposed inside the fixing sleeve support 27C in such a manner that the resin member 27D contacts an inner circumferential surface of the fixing sleeve support 27C, providing an improved rigidity.

As described above, when the fixing device 20 is installed in the image forming apparatus 1 depicted in FIG. 3, the image forming apparatus 1 can stabilize the fixing temperature and improve fixing performance.

In the fixing device 20 according to the above-described exemplary embodiments, the pressing roller 31 is used as a pressing member. Alternatively, a pressing belt or the like may be used as a pressing member to provide the effects equivalent to those provided by the pressing roller 31. Further, the fixing sleeve 21 is used as a fixing member. Alternatively, an endless fixing belt, an endless fixing film, or the like may be used as a fixing member.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

an endless belt-shaped fixing member formed into a loop and rotating in a predetermined direction of rotation;

a nip formation member provided inside the loop formed by the fixing member;

a pressing member provided outside the loop formed by the fixing member and opposite the nip formation member to press the fixing member against the nip formation member to form a nip between the pressing member and the fixing member through which the recording medium bearing the toner image passes;

a heat generator facing an inner circumferential surface of the fixing member to heat the fixing member;

a heat generator support provided inside the loop formed by the fixing member to support the heat generator at a predetermined position between the fixing member and the heat generator support;

a temperature detector provided downstream from the heat generator and upstream from the nip formation member in the direction of rotation of the fixing member to detect a temperature of the fixing member; and a controller connected to the temperature detector and the heat generator to control heat generation of the heat generator based on the temperature of the fixing member detected by the temperature detector, wherein the temperature detector comprises a plurality of detection elements aligned in an axial direction of the fixing member, wherein the fixing device further comprising a core holder provided inside the loop formed by the fixing member to support the temperature detector, wherein the plurality of detection elements comprises:

a center detection element provided at a center of the core holder in a longitudinal direction thereof parallel to the axial direction of the fixing member; and a plurality of lateral-end detection elements provided at lateral ends of the core holder in the longitudinal direction thereof, respectively.

2. The fixing device according to claim 1, wherein the temperature detector contacts the inner circumferential surface of the fixing member.

3. The fixing device according to claim 1, wherein the temperature detector is isolated from the inner circumferential surface of the fixing member.

4. The fixing device according to claim 1, wherein each of the plurality of detection elements is positioned substantially equidistant from the nip in the direction of rotation of the fixing member.

5. The fixing device according to claim 1, further comprising a plurality of flanges contacting lateral ends of the core holder in the longitudinal direction thereof, respectively, each of the flanges including a plurality of engagement portions, wherein the core holder comprises a plurality of slits provided at each of the lateral ends of the core holder in the longitudinal direction thereof to engage the plurality of engagement portions of the flange.

6. An image forming apparatus comprising the fixing device according to claim 1.

* * * * *